US005153109A

United States Patent [19]

Abe et al.

[11] Patent Number: 5,153,109

[45] Date of Patent: Oct. 6, 1992

[54] METHOD FOR PROCESSING SILVER HALIDE COLOR PHOTOSENSITIVE MATERIALS

[75] Inventors: Akira Abe; Yoshihiro Fujita; Keiji Mihayashi, all of Kanagawa, Japan

[73] Assignee: Fuji Photo Film Co., Ltd., Kanagawa, Japan

[21] Appl. No.: 563,898

[22] Filed: Aug. 7, 1990

Related U.S. Application Data

[63] Continuation of Ser. No. 173,477, Mar. 25, 1988, abandoned.

[30] Foreign Application Priority Data

Mar. 25, 1987 [JP] Japan ..... 62-71049
Dec. 28, 1987 [JP] Japan ..... 62-335572

[51] Int. Cl.[5] ..... G03C 7/26; G03C 7/30

[52] U.S. Cl. ..... 430/372; 430/380; 430/399; 430/551

[58] Field of Search ..... 430/372, 384, 385, 393, 430/428, 429, 463, 489, 490, 491, 484, 551, 552, 553, 399, 380

[56] References Cited

U.S. PATENT DOCUMENTS 2,336,327 11/1941 Weissberger et al. ..... 430/505
2,701,197 2/1955 Thirtle et al. ..... 430/372
4,198,239 4/1980 Credner et al. ..... 430/372
4,277,558 7/1981 Kikuchi et al. ..... 430/372
4,500,635 2/1985 Aoki et al. ..... 430/384
4,511,647 4/1985 Hirano et al. ..... 430/384
4,546,068 10/1985 Kuse ..... 430/375
4,732,845 3/1988 Keiji et al. ..... 430/372
4,774,169 9/1988 Kuse et al. ..... 430/372
4,778,743 10/1988 Ishikawa et al. ..... 430/376
4,778,746 10/1988 Ishikawa et al. ..... 430/384

*Primary Examiner*—Richard L. Schilling
*Attorney, Agent, or Firm*—Sughrue, Mion, Zinn, Macpeak & Seas

[57] ABSTRACT

A method for processing a silver halide color photosensitive material, which comprises developing a silver halide color photosensitive material containing at least one compound selected from the group consisting of compounds represented by formula [A], bis or tris compounds and polymers derived therefrom, and alkali unstable precursors thereof, in a color developer which is replenished at a rate of not more than 9 ml per 100 $cm^2$ of the silver halide color photosensitive material;

[A]

wherein $R_a$ and $R_b$ each represents a hydrogen atom, a halogen atom, —$SO_3M$, —COOM (wherein M represents H, an alkali metal atom or $NH_4$), an alkyl group, an acylamino group, an alkoxy group, an aryloxy group, an alkythio group, an arylthio group, a sulfonyl group, an acyl group, a carbamoyl group or a sulfamoyl group and they may together form a carbon ring; X represents a —CO— group or a —$SO_2$— group; $R_c$ represents an alkyl group, an aryl group, a heterocyclic group, a cycloalkyl group, an alkoxy group, an aryloxy group or an amino group; and the total number of carbon atoms of $R_a$, $R_b$ and $R_c$ is at least 10.

17 Claims, No Drawings

METHOD FOR PROCESSING SILVER HALIDE COLOR PHOTOSENSITIVE MATERIALS

This is a continuation of application Ser. No. 07/173,477 filed Mar. 25, 1988 now abandoned.

FIELD OF THE INVENTION

This invention concerns a method for processing silver halide color photosensitive materials, and more precisely it concerns an improved method of processing in which there is no change in the processing performance even when the amount of replenishment of the color development bath is reduced.

BACKGROUND OF THE INVENTION

Investigation has been carried out in connection with reducing the amount of effluent produced in processing in recent years in the light of both the protection of the environment and cost, and a practical stage has been reached with some processing operations. With color development processes, in particular, the sludge loading, such as the BOD and COD etc., of the effluent is very high and a variety of techniques for reducing the level of pollution have been proposed in the past. For example methods of regeneration using electrodialysis have been disclosed in Japanese Patent Application (OPI) Nos. 37,731/79, 1,048/81, 1,049/81, 27,142/81, 33,644/81 and 149,036/81 etc., methods of regeneration using active carbon have been disclosed in Japanese Patent Publication No. 1,571/80 and Japanese Patent Application (OPI) No. 14,831/83, an ion exchange membrane method has been disclosed in Japanese Patent Application (OPI No. 105,820/77 and methods of regeneration using ion exchange resins have been disclosed in Japanese Patent Application (OPI) Nos. 132,343/78, 144,240/80 and 146,249/82 and in U.S. Pat. No. 4,348,475, etc. (The term "OPI" indicates an unexamined published patent application opened to public inspection.)

However, with all of these methods a high level of supervision involving analysis and control of the composition of the developer bath is required and since this necessitates the use of expensive apparatus such techniques are only suitable for use in some large scale developing laboratories.

On the other hand, a method in which the amount of effluent is reduced by lowering the rate of replenishment of the color development bath with controlling the formation of the replenisher without regeneration in the ways described above has come into operation more recently.

This method is good in that it does not require the use of expensive apparatus and does not involve control of the composition by means of analysis.

However, there are serious disadvantages with this method in that the oxidation of the preservatives which occurs as a result of the increased evaporation-concentration and the elongated residence time of the liquid in the processing tank due to the reduction of the replenishment amount, the degradation of the developing agent caused thereby interact to each other, and the processing performance is liable to marked fluctuations.

The above-mentioned problems increase as the extent of the reduction in the replenishment amount is increased, and they become very marked in small scale processing laboratories where the amount of replenishment is particularly small.

Fluctuations in processing performance of this type result in fluctuations in the gradation of the color photosensitive materials after processing and increased staining.

Consequently, small replenishment amount processing methods of this type have the advantages indicated above but they also give rise to problems with fluctuation in processing performance, and so they are subject to the same limitations as the regeneration methods in that they are suitable for use only in large scale processing laboratories where large amounts of material are being processed.

Against this background, the development of a small replenishment amount processing method which provides a stable processing performance even when the amount of material processed is small is clearly desirable in this industry.

On the other hand, it has long been known that color staining occurs as a result of the diffusion and migration of the oxidized product of the developing agent between layers of different color sensitivities in photosensitive materials. For example the use of alkyl and aryl hydroquinones as agents for the prevention of this type of color staining is disclosed in U.S. Pat. Nos. 2,336,327, 2,418,613, 2,419,613, 2,732,300, 3,700,453 and 3,960,570 etc., the use of the nucleus substituted hydroquinones with electron attractive groups is disclosed in U.S. Pat. No. 4,277,553 etc. and the use of the nucleus substituted hydroquinones with carbamoyl groups is disclosed in Japanese Patent Application (OPI) No. 22,237/82 etc. Furthermore, hydroquinones substituted with aliphatic acylamino groups, ureido groups, urethane groups etc. are suggested in U.S. Pat. No. 4,198,239, hydroquinones substituted with sulfonamido groups are suggested in Japanese Patent Application (OPI) No. 202,465/84, and hydroquinones which have a sulfonic acid group and which are substituted with an acyl amino group are suggested in U.S. Pat. No. 2,701,197 as compounds encompassed by the general formula [A] which is described later.

However, the effect of these compounds on the performance after the processing of photosensitive materials in low replenishment rate processing was completely unknown in the past.

SUMMARY OF THE INVENTION

The first object of the invention is to provide a considerable improvement in respect of the fluctuation in processing performance which accompanies low rates of replenishment of a color development bath.

The second object of the invention is to extend the use of low pollution type processing to small scale processing laboratories while at the same time achieving a reduction of processing costs.

The third object of the invention is to provide a method of processing with which it is possible to form color pictures of superior quality.

DETAILED DESCRIPTION OF THE INVENTION

The object of the present invention can be attained by processing a silver halide color photosensitive material containing at least one compound selected from the group consisting of compounds represented by formula [A], bis or tris compounds and polymers derived therefrom, and alkali unstable precursors thereof, in a color developer which is replenished at a rate of not more than 9 ml per 100 $cm^2$ of the silver halide color photosensitive material;

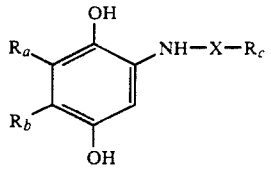

[A]

wherein $R_a$ and $R_b$ each represents a hydrogen atom, a halogen atom, $-SO_3M$, —COOM (wherein M represents H, an alkali metal atom or $NH_4$), an alkyl group, an acylamino group, an alkoxy group, an aryloxy group, an alkylthio group, an arylthio group, a sulfonyl group, an acyl group, a carbamoyl group or a sulfamoyl group and they may together form a carbon ring; X represents a —CO— group or a $-SO_2-$ group; $R_c$ represents an alkyl group, an aryl group, a heterocyclic group, a cycloalkyl group, an alkoxy group, an aryloxy group or an amino group. The total number of carbon atoms of $R_a$, $R_b$ and $R_c$ is at least 10. The compounds of formula [A] are essentially colorless and they do not form a colored image by means of a coupling reaction with an oxidized product of developing agent.

The compounds represented by formula [A] are described in detail below.

In descriptions with respect to compounds used in the present invention numbers in parenthesis show preferable carbon numbers, and each of the acylamino group, sulfonyl group, and sulfamoyl group may be comprised of either aliphatic ($C_1 \sim C_{32}$), alicyclic ($C_4 \sim C_{32}$), aromatic ($C_6 \sim C_{32}$) or heterocyclic ($C_1 \sim C_{32}$) atomic group, and each of acyl group and carbamoyl group may be comprised of either aliphatic ($C_2 \sim C_{32}$), alicyclic ($C_5 \sim C_{32}$) aromatic ($C_7 \sim C_{32}$) or heterocyclic ($C_2 \sim C_{32}$) atomic group.

In the above formula, $R_a$ and $R_b$ which may be the same or different, each represents hydrogen atom, a halogen atom (e.g., a chlorine atom, a bromine atom), $-SO_3M$, —COOM (wherein M represents H, an alkali metal atom or $-NH_4$), an alkyl group ($C_1 \sim C_{32}$; e.g., a methyl group, a pentadecyl group, a t-hexyl group, etc.), an acylamino group ($C_1 \sim C_{32}$; e.g., an acetylamino group, a benzoylamino group, etc.), an alkoxy group ($C_1 \sim C_{32}$; e.g., a methoxy group, a butoxy group, etc.), an aryloxy group ($C_6 \sim C_{32}$; e.g., a phenoxy group, etc.), an alkylthio group ($C_1 \sim C_{32}$; e.g., an octylthio group, a hexadecylthio group, etc.), an arylthio group ($C_6 \sim C_{32}$; e.g., a phenylthio group, etc.), a sulfonyl group (e.g., a dodecanesulfonyl group, a p-toluenesulfonyl group, etc.), an acyl group (e.g., an acetyl group, a benzoyl group, etc.), a carbamoyl group (e.g., an N,N-dibutylcarbamoyl group, etc.) or a sulfamoyl group (e.g., an N,N-diethylsulfamoyl group, etc.), provided that $R_a$ and $R_b$ may be linked to form a ring such as a cycloalkyl group, an indene nucleus, a naphthalene nucleus, a quinoline nucleus and an isoquinoline nucleus. The above-described groups, an alkyl group, an acylamino group, an alkoxy group, an aryloxy group, an alkylthio group, an arylthio group, a sulfonyl group, an acyl group, a carbamoyl group, and a sulfamoyl group may be substituted or unsubstituted. Examples for substituents for the alkyl group, the alkoxy group, the aryloxy group, the alkylthio group, the arylthio group, the sulfonyl group, the acyl group include groups recited above as $R_a$ and $R_b$, and examples for substituents for the carbamoyl group and the sulfamoyl group include an alkyl group and aryl group. X represents —CO— or $-SO_2-$. $R_c$ represents an alkyl group ($C_1 \sim C_{32}$; e.g., a heptadecyl group, a 1-hexylnonyl group, a 1-(2,4-di-t-amylphenoxy)propyl group, etc.), an aryl group ($C_6 \sim C_{32}$; e.g., a phenyl group, a 3,5-bis(2-hexyldecanamido)phenyl group, a 3,4-bis(hexadecyloxycarbonyl)phenyl group, a 2,4-bis(tetradecyloxy)phenyl group, etc.), a heterocyclic group, preferably 5- to 7-membered heterocyclic group having at least one of N, O and S atom as a hetero atom, such as, a pyridinyl group, a pyrrolidinyl group piperidinyl group, a 2-thienyl group, a 2-furyl group, a 4-thiazolyl group, and a 6-pyrimidyl group and a quinolyl group (e.g., a 2,6-dihexyloxypyridin-4-yl group, an N-tetradecylpyrrolidin-2-yl group, an N-octadecylpiperidin-3-yl group, etc.), a cycloalkyl group ($C_3 \sim C_{32}$; e.g., a 3-decanamido-cyclohexyl group, a 3-{(2,4-di-t-amylphenoxy)butanamido ]cyclohexyl group, etc.), an alkoxy group ($C_1 \sim C_{32}$; e.g., a hexadecyloxy group, etc.), an aryloxy group ($C_6 \sim C_{32}$; e.g., a 4-t-octylphenoxy group, etc.) or an amino group (e.g., an octadecylamino group, etc.), which may be unsubstituted or substituted. Examples for substituents include a halogen atom, an alkyl group, an alkoxy group, an aryloxy group, a carbonamido group, a sulfonamido group, an alkylthio group, an arylthio group, an aryl group, an alkoxycarbonyl group, and a carbamoyl group, and these groups may be further substituted with such groups.

The sum of the carbon atoms contained in $R_a$, $R_b$, and $R_c$ should be 10 or more to provide non-diffusibility to the compound. The sum of the carbon atoms preferably at least 15, and it is preferably not more than 64.

The compounds of the general formula [A] may be linked at at least one of $R_a$, $R_b$ and $R_c$ to form a bis compound, a tris compound or a polymer thereof.

In formula [A], $R_a$ and $R_b$ preferably each represents a hydrogen atom, a halogen atom, an alkyl group, an alkoxy group, or an alkylthio group. Of these, a hydrogen atom, a halogen atom, and an alkyl group are more preferred, and a hydrogen atom is most preferred.

As X in formula [A], —CO— is preferred.

In formula [A], preferred $R_c$ groups include an alkyl group and an aryl group, with an aryl group being most preferred.

When $R_c$ in formula [A] represents an aryl group, substituents for the aryl group are not particularly limited so long as it is a conventional substituent for an aryl group, and preferred substituents include a halogen atom, an alkyl group, an amido group, a sulfonamido group, an alkoxy group, an alkoxycarbonyl group, and a carbamoyl group. The aryl group preferably does not contain a sulfo group ($-SO_3M$), a carboxyl group (—COOM), or other such water-soluble group, because these groups can adversely affect preservability of light-sensitive materials.

The compounds of formula [A] are used to prevent the occurrence of the fluctuations in gradation and the increase in staining which are problems when processing is carried out with a low rate of replenishment of the color development bath, and so any coloration of the compounds themselves or the formation of a colored image during the development process is undesirable.

Hence firstly, the compounds of this invention are essentially colorless. In this context being essentially colorless signifies that the compound does not have an absorbance with a molar extinction coefficient of 5,000 or more in the visible wavelength region from 400 nm to 700 nm. Secondly, the compounds used in the invention do not have within the molecule a coupler residue (for example an acylacetanilido residue, 5-pyrazolone residue, 1-naphthol residue) which is known to undergo a coupling reaction with the oxidized product of a color developing agent and form an image, and they do not form a colored image by means of a coupling reaction during the development process.

An alkali unstable precursor of a compound which can be represented by formula [A] in this invention signifies a compound in which the hydroxyl groups in the 1 and 4 positions of the hydroquinone skeleton have protecting groups which can be removed under alkaline conditions.

Typical examples of such protective groups include acyl groups (for example acetyl groups, chloracetyl groups, benzoyl groups, ethoxycarbonyl groups etc.) and groups which can undergo $\beta$-eliminatable for example 2-cyanoethyl groups, 2-methanesulfonylethyl groups, 2-toluenesulfonylethyl groups etc.).

The compounds which can be represented by formula [A] of this invention and the alkali unstable precursors thereof can be prepared easily using the methods disclosed, for example in U.S. Pat. No. 2,701,197, Japanese Patent Publication No. 37,497/84, Japanese Patent Application (OPI) No. 202,465/84 etc.

Examples of compounds represented by formula [A] of this invention and alkali unstable precursors thereof are indicated below but the invention is not limited to these examples.

Compound No.

(1)

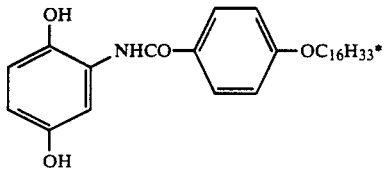

(*: n-alkyl group; hereinafter the same where having no indication)

(2)

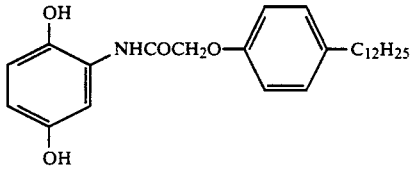

(3)

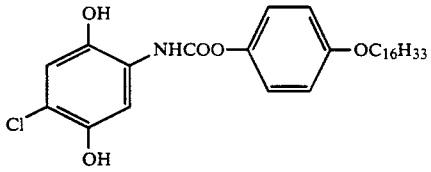

(4)

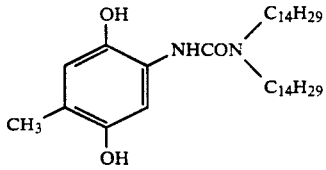

(5)

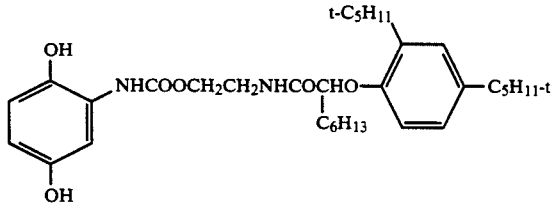

(6)

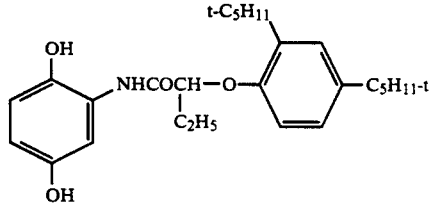

-continued
Compound No.
(7)
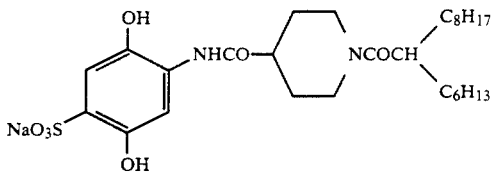
(8)
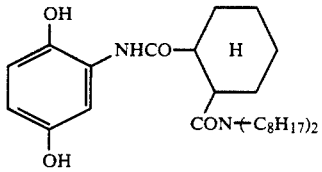
(9)
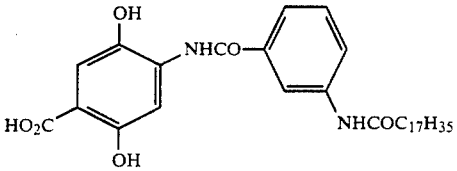
(10)
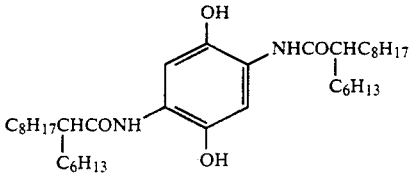
(11)
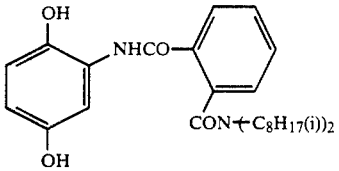
(12)
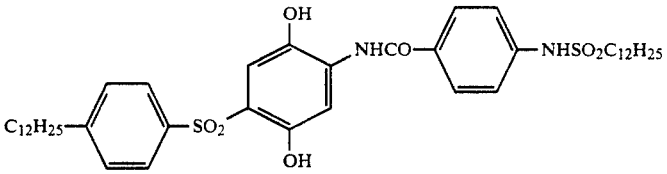
(13)
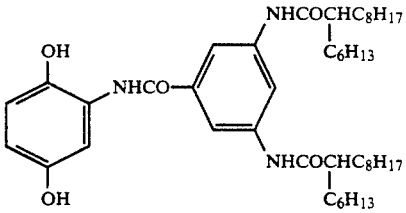
(14)
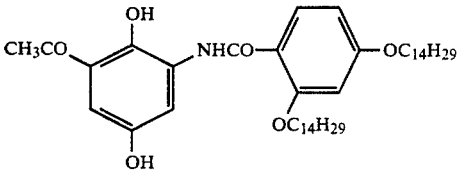

-continued
Compound No.
(15)
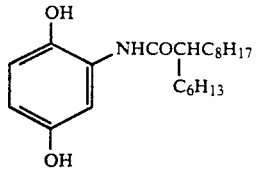
(16)
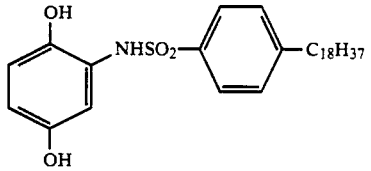
(17)
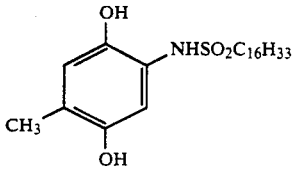
(18)
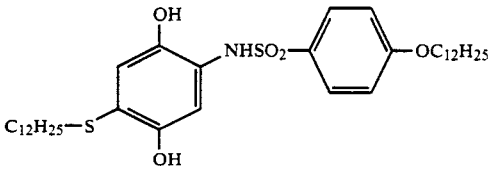
(19)
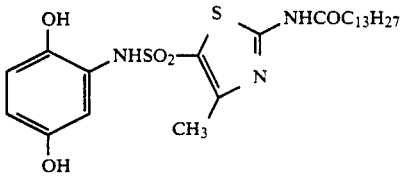
(20)
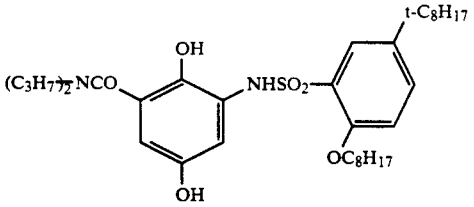
(21)
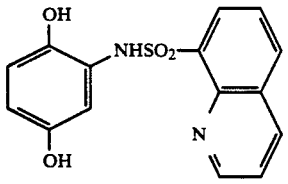
(22)
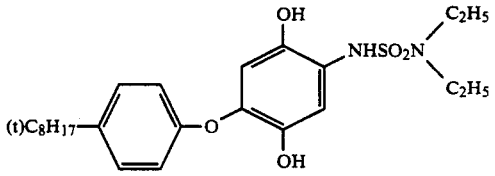

-continued
Compound No.
(23)
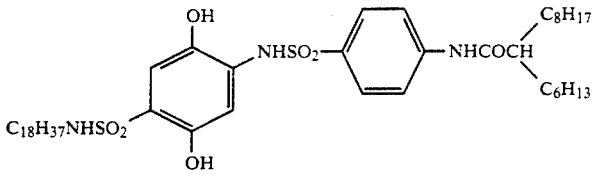
(24)
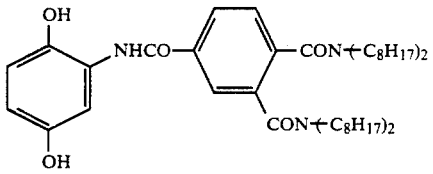
(25)
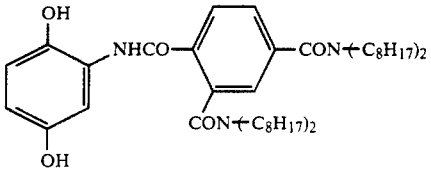
(26)
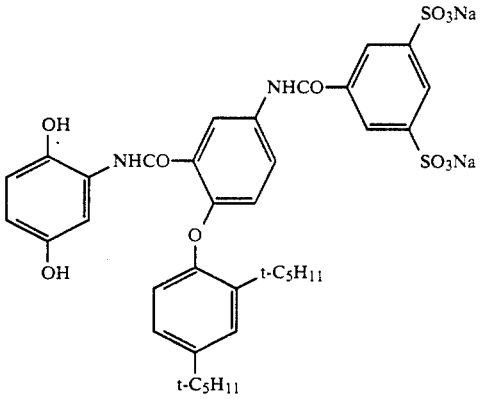
(27)
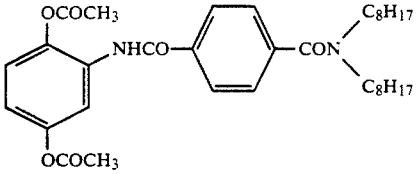
(28)
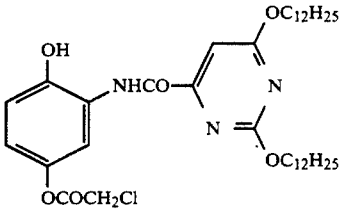
(29)
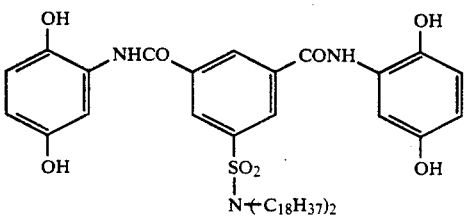

-continued

Compound No.

(30)

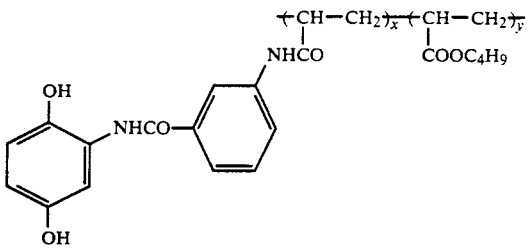

x:y = 1:2 (mol ratio)
Average molecular weight 20,000

In this invention, the compounds represented by formula [A] can be added to any layer in the photosensitive material, but they are preferably added to a non-photosensitive layer and most desirably the non-photosensitive layer is an intermediate layer between two of silver halide emulsion layers which have different color sensitivities from each other.

The compounds represented by formula [A] of this invention and the alkali unstable precursors thereof can be added to the photosensitive material using the same methods as those used for the dispersion and addition of the couplers which are described later.

The total amount of these compounds incorporated into a photosensitive material is preferably from 0.003 to 2.0 g/m$^2$, more preferably from 0.005 to 1.0 g/m$^2$ and most preferably from 0.02 to 0.3 g/m$^2$.

The invention is described in more detail below. The inventors have found that greater fluctuation in gradation and increased staining of color photosensitive materials occur when the rate of replenishment is reduced in order to reduce the amount of pollution and to attain lower costs, and that these problems are especially remarkable when processing is carried out in such a way that the color development bath replenisher is added in amounts of not more than 9 ml per 100 cm$^2$ of the silver halide color photosensitive material.

In general, with the color photosensitive materials which contain silver iodide, for example, color negative films, the replenishment rate of the color developer bath is about 12 ml per 100 cm$^2$ and no especially large processing fluctuations are observed when such a rate of replenishment is used. However, when the rate of replenishment falls below 9 ml, the gradation of the color photosensitive material after processing tends to have a harder contrast and shows increased staining as a result of the concentration of the developer by evaporation.

On the other hand, the residence time of the developer in the color development tank is increased when the rate of replenishment is reduced, and the increase in contrast becomes more pronounced when the hydroxylamine and sulfites etc. which have been added as preservatives are decreased. The color developing agent is also oxidized and decreased as the oxidation of these preservatives proceeds and the development activity of the color development bath decreases, and as a result of this the gradation aforementioned reverts to a soft gradation.

It is possible to design a replenisher composition for cases where the amount of material being developed is constant, by considering the concentrating effects and the oxidation of the preservatives.

However, in development laboratories the amount of material being developed varies greatly from the early to the later part of the week and with the season of the year, and so it is impossible to overcome the problem by considering just the replenisher composition as indicated above.

Since the concentration of the liquid and the oxidation conditions vary according to fluctuations in the amount of material processed, the area of contact between the air and the developer in the color development tank and the operating time, the gradation and staining of the color photosensitive material after processing varies greatly and it is impossible to obtain a stable finish.

Since no method has been discovered in the past for overcoming these problems, satisfactory low rates of replenishment have been impossible.

However, the abovementioned problems can be ameliorated considerably by including a compound represented by the aforementioned formula [A] in the color photosensitive material, and surprisingly stable processing properties can then be obtained even at replenishment rates of 9 ml or less per 100 cm$^2$.

Replenishment of the color development bath can be carried out at a rate of 9 ml or less per 100 square centimeters in this invention, but the effects of use of the compound can be seen clearer at replenishment rates of 7 ml or less and an especially marked effect is observed at replenishment rates of 5 ml or less.

By reducing the amount of replenishment the pollution problem can be greately overcome and the cost for the processing can be lowered, however, in order to prevent deterioration of photographic performances by reduction of replenishment, the rate is generally set to at least 1 ml but not more than 9 ml, preferably to at least 2 ml and not more than 7 ml and most preferably to at least 2 ml and not more than 5 ml.

In this invention the concentration of a bromide compound(s) used as an antifoggant in the color developer replenisher is set to not more than $4\times10^{-3}$ mol per liter, but it is necessary to adjust the bromide concentration in accordance with the extent of the lowering of the replenishment rate, and in general the bromide concentration in the replenisher must be reduced as the replenishment rate is reduced. With a replenishment rate of 5 ml or less, at which the effect of the invention is clearest, a bromide concentration in the color developer replenisher of essentially zero is preferred in order to prevent excessive retardation of development when the photosensitive material contains bromide which is dissolved out during development.

The use of alkali metal salts such as potassium bromide, sodium bromide etc. and hydrobromic acid is preferred as the bromide.

The primary aromatic amine color developing agents used in the color development solution and in the color developer replenisher in this invention include those which are conventional and widely used in the processing of a variety of color photographic processes. These developing agents include aminophenol derivatives and p-phenylenediamine derivatives. These compounds can be used in the form of a salt, for example as a hydrochloride or sulfate, since these are generally more stable than the free compounds. Furthermore, these compounds are generally used at a concentration of from about 1 to about 15 grams per liter of color development bath and preferably at a concentration of from about 3 to about 10 grams per liter of color development bath. The concentration of the developing agent in the replenisher is usually larger than that in the color developer solution in an amount of from 10 to 20%. The amount of the developing agent in the replenisher is set in such a manner that the concentration thereof in the developer can be kept to be constant.

The aminophenol developing agents include, for example, o-aminophenol, p-aminophenol, 5-amino-2-oxytoluene, 2-amino-3-oxytoluene, 2-oxy-3-amino-1,4-dimethylbenzene etc.

The N,N'-dialkyl-p-phenylenediamine compounds are especially useful primary aromatic amine color developing agents, and the alkyl groups and the phenyl group may be substituted with arbitrary substituents. Among these compounds 4-(N-ethyl-N-dodecylamino)-2-methylaniline sulfate, 4-(N-ethyl-N-β-methanesulfonamidoethylamino)-2-methylaniline sulfate, 4-(N-ethyl-N-β-hydroxyethylamino)-2-methylaniline sulfate, 4-(N-ethyl-N-β-methoxyethylamino)-2-methylaniline-p-toluenesulfonic acid salt, 4-(N,N-diethylamino)-2-methylaniline hydrochloride and N,N-diethyl-p-phenylenediamine hydrochloride etc. can be cited as especially useful compounds.

Among these compounds, the use of 4-(N-ethyl-N-β-hydroxyethylamino)-2-methylaniline is preferred in this invention.

The compounds indicated above are generally used individually but, depending on the intended purpose, two or more of these compounds can be used in combination. Examples of preferred combinations include the use of 4-(N-ethyl-N-β-hydroxyethylamino)-2-methylaniline with 4-(N-ethyl N-β-methanesulfonamidoethylamino)-2-methylaniline, and the use of 4-(N-ethyl-N-β-hydroxyethylamino)-2-methylaniline with 4-(N-ethyl-N-β-methoxyethylamino)-2-methylaniline.

Furthermore, the inclusion of at least one compound selected from the group consisting of compounds represented by the general formula [B] or formula [C] as indicated below is desirable in this invention.

The inclusion of at least one compound represented by formula [B] and at least one compound represented by formula [C] in combination is especially desirable, especially in improvement of stability.

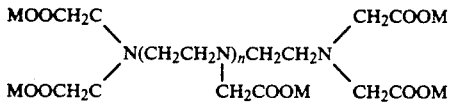

[B]

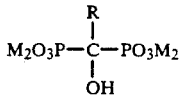

[C]

wherein n represents 1 or 2, R represents a lower alkyl group, preferably having from 1 to 3 carbon atoms, and M represents a hydrogen atom, an alkali metal atom (such as Na, K and Li) or an ammonium group, and M may be the same or different.

R preferably is a methyl group or an ethyl group and M preferably is a hydrogen atom or a sodium atom.

Compounds represented by formula [B] or [C] have an excellent effect in that they prevent the deterioration of preservatives such as hydroxylamine compound (e.g., hydroxylamine, diethylhydroxylamine and monomethylhydroxylamine) etc. under low replenishment conditions, prevent the gradation of the photosensitive material from increasing in contrast after processing, prevent the deposition of a calcium compound upon using hard water, and stabilize the developing agent in the developer.

Examples of compounds represented by the general formula [B] or [C] are indicated below.

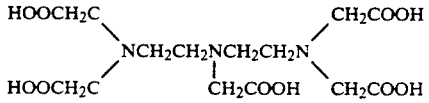

B-1

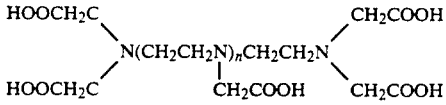

B-2

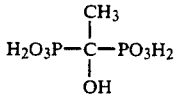

C-1

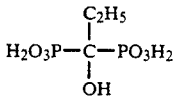

C-1

The compounds of formula [B] are added in an amount of from $5\times10^{-4}$ to $5\times10^{-2}$ mol, and preferably of from $1\times10^{-3}$ to $1\times10^{-2}$ mol, per liter of color developer.

Furthermore, the compounds of formula [C] are added in an amount of from $1\times10^{-3}$ to $1\times10^{-1}$ mol, and preferably at a rate of from $5\times10^{-3}$ to $5\times10^{-2}$ mol, per liter of color developer.

When compounds of formula [B] and compounds of formula [C] are used in combination, synergistic effects can be obtained. In order to obtain such effects the compound of formula [C] is used in a mol ratio of from 2 to 20 times, preferably of from 3 to 15 times, and most desirably of from 3 to 10 times, with respect to the compound of formula [B].

Compounds B-1 and C-1 among examples indicated above are especially desirable.

As well as the compounds mentioned above pH buffers such as alkali metal carbonates, borates or phosphates; development restrainers or anti-foggants such as iodides, benzimidazoles, benzothiazoles or mercapto compounds; preservatives such as hydroxylamine, diethylhydroxylamine, triethanolamine, the preservatives (e.g., α-aminocarbonyl compounds) disclosed in Japanese Patent Application No. 265,149/86 or west German Patent Application (OLS) No. 2,622,950, sulfites or bisulfites; organic solvents such as diethylene glycol; development accelerators such as benzyl alcohol, polyethylene glycol, quaternary ammonium salts, amines, thiocyanates, 3,6-thiaoctan-1,8-diol; dye forming couplers; competitive couplers, nucleating agents such as sodium borohydride; auxiliary developing agents such as 1-phenyl-3-pyrazolidone; viscosity imparting agents; and chelating agents, which are used, for example, to prevent the deposition of a calcium or a magnesium compound upon using of hard water, to prevent the deposition of an iron, copper or manganese compound which is intermixed as impurities, and to keep stability of preservatives, such as ethylenediamine tetraacetic acid, nitrilo triacetic acid, cyclohexanediamine tetraacetic acid, iminodiacetic acid, N-hydroxymethylethylenediamine triacetic acid, the organic phosphonic acids disclosed in Research Disclosure 18170 (May 1979), aminophosphonic acids such as aminotris(methylenephosphonic acid), ethylenediamine-N,N,N',N'-tetramethylenephosphonic acid etc. and the phosphonocarboxylic acids etc. disclosed in Japanese Patent Application (OPI) Nos. 102,726/77, 42,730/78, 121,127/79, 4,024/80, 4,025/80, 126,241/80, 65,955/80 and 65,956/80 and in Research Disclosure No. 18170 (May 1979) can be included in the color development baths which are used in this invention.

The pH value of the color development bath used in the invention is generally above 8, more generally from about 9 to about 12 and preferably from 9.5 to 11.

The processing temperature of the color development solution in this invention is generally from 20° to 50° C., preferably from 30° to 45° C. and most desirably from 35°–42° C. The processing time is from 20 seconds to 10 minutes and preferably from 30 seconds to 5 minutes.

After color development the photosensitive material is processed in a bleaching bath or a bleach-fixing bath in this invention and the ferric ion complexes used as bleaching agents in these baths are complexes of ferric ions with chelating agents such as amino-polycarboxylic acids, amino-polyphosphonic acids, or salts thereof. The amino-polycarboxylic acid salts or amino-polyphosphonic acid salts are the alkali metal, ammonium or water soluble amine salts of the amino-polycarboxylic acids or amino-polyphosphonic acids. The alkali metal is sodium, potassium, lithium etc. and the water soluble amine is an alkylamine such as methylamine, diethylamine, triethylamine or butylamine, an alicyclic amine such as cyclohexylamine, an arylamine such as aniline or m-toluidine or a heterocyclic amine such as pyridine, morpholine or piperidine.

Typical examples of these amino-polycarboxylic acid and amino-polyphosphonic acid chelating agents include ethylenediamine tetra-acetic acid, diethylenetriamine penta-acetic acid, ethylenediamine-N-(β-oxyethyl)-N,N',N'-tri-acetic acid, 1,2-diaminopropane tetra-acetic acid, 1,3-diaminopropane tetra-acetic acid, nitrilo tri-acetic acid, cyclohexanediamine tetra-acetic acid, imino di-acetic acid, dihydroxyethylglycine, ethyl ether diamine tetra-acetic acid, glycol ether diamine tetraacetic acid, ethylenediamine tetra-propionic acid, phenylenediamine tetra-acetic acid etc. but they are not limited to these illustrative compounds. The ferric ion complex salts may be used in the form of the complex salts or the ferric ion complex salt may be formed in solution using a ferric salt, for example, ferric sulfate, ferric chloride, ferric ammonium sulfate, ferric phosphate etc. and a chelating agent such as an amino-polycarboxylic acid, amino-polyphosphonic acid, phosphonocarbxylic acid etc. When they are used in the form of a complex salt, either a single type of complex salt or two or more types of complex salt may be used. On the other hand, when the complex salt is formed in solution using a ferric salt and a chelating agent one or more types of ferric salt can be used. Moreover one or more types of chelating agent can also be used. Furthermore, in all cases the chelating agent may be used in excess the amount required to for the ferric iron complex salt. Among these iron complexes amino-polycarboxylic acid iron complexes are preferred.

The amount of the complexes added is preferably from 0.1–1 mol per liter and more preferably from 0.2–0.4 mol per liter in the case of a bleaching bath, and preferably from 0.05–0.5 mol per liter and more preferably from 0.1 to 0.3 mol per liter in the case of a bleach-fixing bath for color photosensitive materials used for taking photographs such as color negative films. Furthermore, the amount added is preferably from 0.03–0.3 mol per liter and more preferably from 0.05 to 0.2 mol per liter in the case of a bleaching bath or bleach-fixing bath for color photographic printing materials such as color papers.

Furthermore, bleach accelerators can be used as desired in the bleaching bath and bleach-fixing bath. Examples of useful bleach accelerators include the compounds which have mercapto groups or disulfide groups disclosed in U.S. Pat. No. 3,893,858, West German Patent Nos. 1,290,812 and 2,059,988, Japanese Patent Application (OPI) Nos. 32,736/78, 57,831/78, 37,418/78, 65,732/78, 72,623/78, 95,630/78, 95,631/78, 104,232/78, 124,424/78, 141,623/78 and 28,426/78 and in Research Disclosure No. 17129 (July 1978) etc.; the thiazolidine derivatives disclosed as in Japanese Patent Application (OPI) No 140,129/75; the thiourea derivatives disclosed in Japanese Patent Publication No. 8,506/70, Japanese Patent Application (OPI) Nos. 20,832/77 and 32,735/78 and in U.S. Pat. No. 3,706,561; the iodides disclosed in West German Patent No. 1,127,715 and in Japanese Patent Application (OPI) No. 16,235/83; the polyethyleneoxides disclosed in West German Patent Nos. 966,410 and 2,748,430; the polyamine compounds disclosed in Japanese Patent Publication No. 8,836/70; and other compounds disclosed in Japanese Patent Application (OPI) Nos. 42,434/74, 59,644/74, 94,927/78, 35,727/79, 26,506/80 and 163,940/83 and iodine and bromine ions etc. Among these compounds those which have a mercapto group or a disulfide group are preferred from the point of view of the magnitude of the accelerating effect and the compounds disclosed in U.S. Pat. No. 3,893,858, West German Patent No. 1,290,812 and Japanese Patent Application (OPI) No. 95,630/78 are especially desirable.

Re-halogenating agents such as bromides (for example, potassium bromide, sodium bromide, ammonium bromide) or chlorides (for example, potassium chloride, sodium chloride, ammonium chloride) or iodides (for example, ammonium iodide) can be included in the bleaching bath or bleach-fixing bath used in this invention. One or more type of inorganic acid, organic acid or alkali metal or ammonium salts thereof, such as boric acid, borax, sodium metaborate, acetic acid, sodium acetate, sodium carbonate, potassium carbonate, phosphorous acid, phosphoric acid, sodium phosphate, citric acid, sodium citrate, tartaric acid etc., which have a pH buffering capacity and anti-corrosion agents such as ammonium nitrate, guanidine etc. may be added as required.

Moreover the above mentioned bleaching bath is generally used at a pH of from 4 to 7, preferably within the range of from 4.5 to 6.5 and more preferably within the range of from 5 to 6.3. Moreover, for a bleach-fixing bath the pH is generally from 4 to 9, preferably from 5 to 8 and more preferably from 5.5 to 7.5. Bleaching failure is liable to arise in cases where the pH is above the ranges indicated and color failure of the cyan dye is liable to occur when the pH is below the indicated range.

The fixing agent which may be used in this invention which is used in the bleach-fixing, or in the fixing bath which is used after the bleaching bath, is a known fixing agent, which is to say a water soluble silver halide dissolving agents such as a thiosulfate, for example, sodium thiosulfate, ammonium thiosulfate etc.; a thiocyanate, for example, sodium thiocyanate, ammonium thiocyanate etc.; a thioether compound, for example, ethylenebisthioglycolic acid, 3,6-dithia-1,8-octandiol etc. or thioureas etc., and these can be used individually or in a combination of two or more agents. The use of thiosulfates, especially ammonium thiosulfate, is preferred in this invention.

The amount of fixing agent used is preferably from 0.3 to 2 mol per liter and more precisely the use of a concentration of from 0.8 to 1.5 mol per liter is used for processing color photosensitive materials which are used for taking photographs and a concentration of from 0.5 to 1 mol per liter is used for processing color photographic printing materials.

The pH range of the fixing bath used in this invention is preferably between 4 and 9 and more preferably between 5 and 8. If the pH is below this range the bath deteriorates markedly, while at pH values above this range ammonium may be released from the ammonium salts which are contained in the bath and staining is liable to occur.

Hydrochloric acid, sulfuric acid, nitric acid, acetic acid, bicarbonates, ammonia, caustic potash, caustic soda, sodium carbonate, potassium carbonate etc. can be added as required in order to adjust the pH.

Compounds which release sulfite ions, such as sulfites (for example, sodium sulfite, potassium sulfite, ammonium sulfite etc.), bisulfites (for example, ammonium bisulfite, sodium bisulfite, potassium bisulfite etc.), metabisulfites (for example, potassium metabisulfite, sodium metabisulfite, ammonium metabisulfite etc.) etc., are included as preservatives in the bleach-fixing bath and fixing bath which are used in the invention.

These compounds are preferably included in an amount, calculated as sulfite ion, of from about 0.02 to 0.50 mol per liter and most desirably at a rate of from 0.04 to 0.40 mol per liter.

A sulfite is usually added as a preservative but other preservatives such as ascorbic acid, carbonyl bisulfite addition compounds or carbonyl compounds etc. may be added.

Moreover, buffering agents, fluorescent whitening agents, chelating agents, fungicides etc. may also be added as required.

A water washing and stabilization process etc. are generally carried out after the fixing process or bleach-fixing process and this can be carried out in a simple processing method by carrying just a water wash or by carrying out a stabilization process essentially without a water washing processes.

The water washing process removes the processing bath components which have become attached to or adsorbed in the color photosensitive material or the unwanted components from within the color photosensitive material, and in this way it has the effect of providing good post processing image storage properties and film properties.

On the other hand, a stabilizing process is a process which improves the storage properties of the image to a level which cannot be achieved by water washing.

There are cases in which the water washing process is carried out in a single tank but it is often carried out in a multi-stage counter-flow washing system with two or more tanks. The amount of water used in the water washing process can be set arbitrarily in accordance with the type and intended purpose of the color photosensitive material but it can also be calculated by means of the method indicated by S.R. Goldwasser in the paper entitled "Water Flow Rates in Immersion Washing of Motion Picture Films" on pages 248-253 of volume 64 of *the Journal of Motion Picture and Television Engineering.*

The growth of bacteria and mold is a problem when the amount of wash water used is reduced, and the use of wash water in which the calcium and magnesium content has been reduced as disclosed in Japanese Patent Application No. 131,632/86 is preferred as a countermeasure. Furthermore, germicides and antifungal agents, for example, the compounds disclosed on pages 207-223 of the Journal of Antibacterial and Antifungal Agents, Vol. 11, No. 5 (1983) and the compounds disclosed by Hiroshi Horiguchi in "Bokin Bobai no Kagaku" can be added. Furthermore, chelating agents such as ethylenediamine tetra-acetic acid, diethylenetriamine penta-acetic acid etc. can be added as hard water softening agents.

In cases where the amount of wash water is reduced, the amount used is generally from 100 ml to 2,000 ml per square meter of color photographic material but the use of an amount of water in the range of from 200 ml to 1,000 ml is preferred from the points of view of both the stability of the colored image and water economy.

The pH value of the water in the water washing process is generally within the range of from 5 to 9. Various compounds are added in the stabilizing bath for the purpose of stabilizing the image. For example, various buffering agents (for example combination of borates, metaborates, borax, phosphates, carbonates, potassium hydroxide, sodium hydroxide, aqueous ammonia, monocarboxylic acids, dicarboxylic acids, polycarboxylic acids etc. are used) may be added to adjust the pH value of the film after processing and, as in the case of wash water, chelating agents, germicides and fluorescent whitening agents can be added according to the application and various ammonium salts, for example ammonium chloride, ammonium sulfite, ammonium sulfate, ammonium thiosulfate etc. can also be added.

The pH value of the stabilizing bath is generally from 3 to 8 but, as a result of differences in the type and intended use of the photosensitive material, the use of a stabilizing bath of low pH between 3 and 5 is preferred in some cases.

This invention can be applied to a variety of color photosensitive materials. Typical examples include color negative films for general purposes or cinematographic purposes and color reversal films for slides or television purposes etc.

The silver halide emulsions which are used in the invention can be prepared using the methods disclosed in section [I] of item No. 17643 of Research Disclosures, Vol. 176 (1978).

The silver halide used in the color photosensitive materials which are used in the invention may be silver bromide, silver iodobromide, silver iodochlorobromide, silver chlorobromide or silver chloride. Silver iodobromides (3-20 mol % silver iodide) are preferred in the case of high speed photosensitive materials.

The silver halide grains in the photographic emulsion may be so-called regular grains which have a regular crystalline form such as a cubic, octahedral, tetradecahedral or diamond shaped dodecahedral form, or they may have a irregular crystalline form such as a spherical form or they may have crystal defects such as twin crystal planes etc., or they may have a complex form consisting of these forms.

The grain size of the silver halide may include fine grains having a projected area diameter of not more than 0.1 micron and large grains having the diameter reaching up to 10 microns, and they may take the form of a mono-disperse emulsion which has a narrow grain size distribution or a poly-disperse emulsion which has a wide grain size distribution.

Emulsions in which the average grain size of the silver halide grains is greater than about 0.1 micron and at least about 95% by weight of the silver halide grains are within ±40% of the average grain size are typical mono-disperse emulsions. Emulsions of which the average grain size is from about 0.25 to 2 microns and of which at least about 95% by weight, or at least about 95% in terms of the numbers of grains of the silver halide grains, are of a size within ±20% of the average grain size are preferably used in the invention.

The crystal structure may be uniform or the inner and outer parts may have a different halogen composition to provide a layered type of structure. These emulsion grains have been disclosed in British Patent No. 1,027,146, U.S. Pat. Nos. 3,505,068 and 4,444,877 and in Japanese Patent Application (OPI) No. 143,331/85. Furthermore, the silver halides of different compositions may be joined by means of an epitaxial junction.

Improvements in speed which include improvement of the color sensitizing efficiency with sensitizing dyes, improvement of the relationship between speed and granularity, improvement of sharpness, improvement in the progress of development, improvement of the covering power and improvement in respect of crossover etc. can be achieved by using tabular grains in the silver halide emulsions which are used in the invention. Here a tabular silver halide grain is a grain of which the diameter/thickness ratio has a value of at least 5, for example exceeding 8, or at least 5 and not more than 8.

The tabular grains may have a uniform halogen composition or they may consist of two phases which have different halogen compositions. For example, when silver iodobromide is used then silver iodobromide tabular grains which have a layer structure consisting of a plurality of phases which each have a different iodide content can be used. Preferred examples of the halogen compositions and halogen distributions within the grains of tabular silver halide grains have been disclosed in Japanese Patent Application (OPI) Nos. 113,928/83 and 99,433/84.

The preferred method for the use of tabular silver halide grains in this invention is described in detail in Research Disclosure No. 22534 (January 1983) and Research Disclosure No. 25330 (May 1985) where, for example, a method of use based upon the relationship between the thickness and the optical characteristics of the tabular grains is disclosed.

The silver halide photographic emulsions which can be used in the invention can be prepared using the known methods, for example the methods disclosed in Research Disclosure No. 17643 (December 1978), pages 22-23, "Emulsion Preparation and Types" and in Research Disclosure No. 18716 (November 1979), page 648.

Various photographic additives which can be used in the invention are disclosed for example on pages 23-28 of the aforementioned Research Disclosure No. 17643 and pages 648-651 of the aforementioned Research Disclosure No. 18716. The types of additive and the locations of the detailed disclosures are indicated below:

| | Type of Additive | RD 17643 | RD 18716 |
|---|---|---|---|
| 1. | Chemical sensitizers | Page 23 | Page 648, right col. |
| 2. | Sensitivity enhancement | | Page 648, right col. |
| 3. | Spectral sensitizers Supersensitizers | Pages 23-24 | Pages 648 right col. to 649 right col. |
| 4. | Whiteners | Page 24 | |
| 5. | Anti-foggants and Stabilizers | Pages 24-25 | Page 649 right col. |
| 6. | Light absorbers, filter dyes, UV absorbers | Pages 25-26 | Pages 649, right col. to 650, left col. |
| 7. | Anti-staining agents | Page 25, right col. | Page 650 left-right col. |
| 8. | Color image stabilizers | Page 25 | |
| 9. | Film hardening agents | Page 26 | Page 651, left col. |
| 10. | Binders | Page 26 | Page 651, left col. |
| 11. | Plasticizers, lubricants | Page 27 | Page 650, right col. |
| 12. | Coating assistant, surfactants | Pages 26-27 | Page 650, right col. |
| 13. | Anti-static agents | Page 27 | Page 650, right col. |

Various color couplers can be used in the photosensitive materials which can be used in the process of this invention.

In this context, a color coupler is a compound which is able to undergo a coupling reaction with the oxidized product of a primary aromatic amine developing agent and form a dye. There are naphthol and phenol compounds, pyrazolone and pyrazoloazole compounds and open chain or heterocyclic ketomethylene compounds among the typical examples of useful color couplers. Typical examples of the cyan, magenta and yellow couplers which can be used in the invention are disclosed in the patents cited in Research Disclosure (RD) 18717 (November 1979) and section VII-D of Research Disclosure (RD) 17643 (December 1978).

Color couplers which are incorporated into the photosensitive material are preferably nondiffusible as a result of having ballast groups or polymerization. Two equivalent couplers in which the active coupling position is substituted with a coupling-eliminatable group are preferred to four equivalent couplers having a hydrogen atom at the active coupling position from the point of view of reducing the amount of silver which is coated. Moreover, couplers such that the colored dye has appropriate diffusion properties, colorless couplers, or DIR couplers which release development inhibitors and couplers which release development accelerators along with the coupling reaction can also be used.

The oil protected type acylacetamide couplers are typical of the yellow couplers which can be used in this invention. Examples of these compounds have been disclosed in U.S. Pat. Nos. 2,407,210, 2,875,057 and 3,265,506, etc. The use of two equivalent yellow couplers is preferred in this invention and those of the oxygen atom eliminatable type disclosed in U.S. Pat. Nos. 3,408,194, 3,447,928, 3,933,501 and 4,022,620 etc. and those of the nitrogen atom eliminatable type disclosed in Japanese Patent Publication No. 10,739/83, U.S. Pat. Nos. 4,401,752 and 4,326,024, RD 18053 (April 1979), British Patent No. 1,425,020, and West German Patent Application Laid Open Nos. 2,219,917, 2,261,361, 2,329,587 and 2,433,812 etc. are typical examples of such couplers. The α-pivaloylacetanilide couplers have excellent colored dye fastness, especially light fastness, while the α-benzoylacetanilide couplers provide a high color density.

The oil protected type indazolone couplers or cyanoacetyl couplers, and preferably the 5-pyrazolone couplers and pyrazoloazole couplers such as the pyrazolotriazoles etc. are included among the magenta couplers which can be used in the invention. The 5-pyrazolone couplers which are substituted in the 3-position with an arylamino group or an acylamino group are preferred from the point of view of the hue of the colored dye which is formed and the color density, and typical examples of such couplers have been disclosed in U.S. Pat. Nos. 2,311,082, 2,343,703, 2,600,788, 2,908,573, 3,062,653, 3,152,896 and 3,936,015 etc. The eliminatable group of the two equivalent 5-pyrazolone coupler is most desirably a nitrogen atom eliminatable group as disclosed in U.S. Pat. No. 4,310,619 or an arylthio group as disclosed in U.S. Pat. No. 4,351,897. Furthermore, a high color density can be obtained with the 5-pyrazolone couplers which have ballast groups as disclosed in European Patent No. 73,636.

The pyrazoloazole couplers include the pyrazolobenzimidazoles disclosed in U.S. Pat. No. 3,061,432, and the pyrazolo[5,5-c][1,2,4]triazoles disclosed in U.S. Pat. No. 3,725,067, the pyrazolotetrazoles disclosed in Research Disclosure 24220 (June 1984) and Japanese Patent Application (OPI) No. 33,552/85 and the pyrazolopyrazoles disclosed in Research Disclosure 24230 (June 1984) and Japanese Patent Application (OPI) No. 43,659/85 are preferred. The imidazo[1,2-b]pyrazoles disclosed in U.S. Pat. No. 4,500,630 are preferred from the point of view of the low level of side absorption of the yellow of the colored dye and their light fastness and the pyrazolo[1,5-b][1,2,4]triazoles disclosed in U.S. Pat. No. 4,540,654 are most desirable.

Furthermore the conjoint used of a pyrazole elimination two equivalent magenta coupler as disclosed in U.S. Pat. No. 4,367,282 etc. and an arylthio elimination two equivalent magenta coupler as disclosed in U.S. Pat. Nos. 4,366,237 and 4,522,915 etc. is preferred for the magenta coupler.

There are oil protected type naphthol and phenol cyan couplers, and the naphthol couplers disclosed in U.S. Pat. No. 2,474,293 and preferably the oxygen atom elimination type two equivalent naphthol couplers disclosed in U.S. Pat. Nos. 4,052,212, 4,146,396, 4,228,233 and 4,296,200 are typical of these. Examples of phenol couplers have been disclosed in U.S. Pat. Nos. 2,369,929, 2,801,171, 2,772,162, 2,895,826 etc. The use of cyan couplers which are fast to humidity and temperature is preferred in this invention, and the phenol cyan couplers in which an alkyl group consisting of an ethyl group or larger group is substituted in the meta position of the phenol ring as disclosed in U.S. Pat. No. 3,772,002, the 2,5-diacylamino substituted phenol couplers disclosed in U.S. Pat. Nos. 2,772,162, 3,758,308, 4,126,396, 4,334,011 and 4,327,173, West German Patent Laid Open No. 3,329,729 and European Patent No. 121,365 etc., and the phenol based couplers which have a phenylureido group in the 2- position and an acylamino group in the 5- position as disclosed in U.S. Pat. Nos. 3,446,622, 4,333,999, 4,451,559 and 4,427,767 etc. are typical examples of such couplers. The cyan couplers substituted with a sulfonamido group, amido group etc. in the 5- position of the naphthol ring disclosed in Japanese Patent Application (OPI) Nos. 237448/85, 153640/86 and 145557/86 also provide colored images which have excellent fastness and the use of these couplers is preferred in this invention.

The conjoint use of colored couplers is preferred in color negative photosensitive materials for photographing purposes in order to compensate for the unwanted absorptions in the short wavelength regions of the dyes which are formed from the magenta and cyan couplers. The yellow colored magenta couplers disclosed in U.S. Pat. No. 4,163,670 and Japanese Patent Publication No. 39,413/82 etc. and the magenta colored cyan couplers disclosed in U.S. Pat. Nos. 4,004,929, and 4,138,258 and British Patent 1,146,368 etc. are typical examples of such couplers.

Granularity can be improved by the conjoint use of couplers of which the colored dye has an appropriate degree of diffusibility. Typical examples of magenta couplers of this type are disclosed in U.S. Pat. No. 4,366,237 and British Patent No. 2,125,570 and typical examples of yellow, magenta and cyan couplers of this type are disclosed in European Patent No. 96,570 and West German Patent Application Laid Open No. 3,234,533.

The dye forming couplers and the special couplers mentioned above may be formed into polymers consisting of at least dimeric units. Typical examples of polymerized dye forming couplers are disclosed in U.S. Pat. Nos. 3,451,820 and 4,080,211. Typical examples of polymerized magenta couplers are disclosed in British Patent No. 2,102,173, U.S. Pat. No. 4,367,282 and Japanese Patent Application (OPI) Nos. 232455/86 and 54260/87.

Two or more of the various types of coupler can be used conjointly in the same photosensitive layer and the same compound can be introduced into two or more different layers in order to realize the characteristics required in the photosensitive material.

The standard amount of color coupler used is within the range of from 0.001 to 1 mol per mol of photosensitive silver halide and the preferred amounts are from 0.01 to 0.5 mol for the yellow coupler, from 0.003 to 0.3 mol for the magenta coupler and from 0.002 to 0.3 mol for the cyan coupler.

Couplers which release development inhibitors during the course of development, the so-called DIR couplers, may be included in the photosensitive material used in the invention.

The couplers which release heterocyclic mercapto development inhibitors disclosed in U.S. Pat. No. 3,227,554; the couplers which release benzotriazole derivatives as development inhibitors as disclosed in Japanese Patent Publication No. 9,942/83; the so-called colorless DIR couplers disclosed in Japanese Patent Publication No. 16,141/76; the couplers which release nitrogen-containing development inhibitors with the dissociation of a methylol group after elimination disclosed in Japanese Patent Application (OPI) No. 90,932/77; the couplers which release a development inhibitor via an intramolecular nucleophilic reaction after elimination disclosed in U.S. Pat. No. 4,248,962 and Japanese Patent Application (OPI) No. 56,837/87; the couplers which release a development inhibitor by means of an electron transfer via a conjugated system after elimination disclosed in Japanese Patent Application (OPI) Nos. 114,946/81, 154,234/82, 188,035/82, 98,728/83, 209,736/83, 209,737/83, 209,738/83, 209,739/83 and 209,740/83 etc.; the couplers which release diffusible development inhibitors of which the development inhibiting capacity is deactivated in the developer disclosed in Japanese Patent Application (OPI) Nos. 151,944/82 and 217,932/83 etc.; and the couplers which release reactive compounds and form development inhibitors or deactivate a development inhibitor by means of a reaction within the film during development as disclosed in Japanese Patent Application (OPI) Nos. 182438/85 and 184248/85, etc. can be cited as examples of DIR couplers. Of the DIR couplers mentioned above, the incorporation of the developer deactivation type as typified by those disclosed in Japanese Patent Application (OPI) No. 151,944/82; the timing type as typified by those disclosed in U.S. Pat. No. 4,248,962 and Japanese Patent Application (OPI) No. 154,234/82; and the reactive type as typified by those disclosed in Japanese Patent Application (PI) No. 184248/85 is preferred, and of these the developer deactivating type DIR couplers disclosed in Japanese Patent Application (OPI) Nos. 151,944/82, 217,932/83, 218,644/85, 225,156/85 and 233,650/85 etc. and the reactive type DIR couplers disclosed in Japanese Patent Application(OPI) No. 184248/85, etc. are the most desirable.

Compounds which release nucleating agents development accelerators, or precursors thereof (referred to below as development accelerators etc.) in the form of the image during development can be used in the photosensitive materials used in this invention. Typical examples of such compounds are disclosed in British Patent Nos. 2,097,140 and 2,131,188, and the couplers which release a development accelerator by means of a coupling reaction with the oxidized product of a primary aromatic amine developing agent, the so-called DAR couplers.

The development accelerators etc. which are released from the DAR couplers preferably have a group which can be adsorbed on silver halide, and typical examples of such DAR couplers have been disclosed in Japanese Patent Application (OPI) Nos. 157,638/84 and 170,840/84. DAR couplers which produce N-acyl substituted hydrazines which are eliminated from the active coupling position of the photographic coupler at a sulfur atom or nitrogen atom and which have a single or condensed heterocyclic ring as an adsorbing group are preferred and typical examples of such couplers have been disclosed in Japanese Patent Application (OPI) No. 128,446/85.

The compounds disclosed in Japanese Patent Application (OPI) No. 37,556/85 of the type which have a development accelerating part within the coupler residue and the compounds disclosed in Japanese Patent Application (OPI) No. 107,029/85 of the type which release a development accelerating agent by means of an oxidation-reduction reaction with the oxidized product of the developing agent can also be used in the photosensitive materials of this invention.

The DAR couplers are preferably introduced into a photosensitive silver halide emulsion layer of the photosensitive material and essentially non-photosensitive silver halide grains are preferably used conjointly in at least one of the photographic structural layers as disclosed in Japanese Patent Application (OPI) Nos. 172,640/84 or 128,429/85.

The photosensitive materials which can be used in the invention may contain hydroquinone derivatives, aminophenol derivatives, amines, gallic acid derivatives, catechol derivatives, ascorbic acid derivatives, colorless couplers, sulfonamidophenol derivatives etc. as anti-color fogging agents or anti-color mixing agents and the known anti-discoloration agents can be used. Typical examples of the known anti-discoloration agents include hydroquinones, 6-hydroxychromans, 5-hydroxycoumarans, spirochromans, p-alkoxyphenols, hindered phenols centered on bisphenols, gallic acid derivatives, methylenedioxybenzenes, aminophenols, hyndered amines and ethers or esters in which the phenolic hydroxyl groups in these compounds have been silylated or alkylated. Furthermore, metal complexes typified by (bis-salicylaldoxymato)nickel complexes and (bis-N,N-dialkyldithiocarbamato)nickel complexes etc. can also be used.

Ultraviolet absorbers can be added to the hydrophilic colloid layers in the photosensitive materials used in the invention. For example the benzotriazoles substituted with aryl groups disclosed in U.S. Pat. Nos. 3,553,794 and 4,236,013, Japanese Patent Publication 6,540/76 and European Patent No. 57,160 etc., the butadienes disclosed in U.S. Pat. Nos. 4,450,229 and 4,195,999, the cinnamic acid esters disclosed in U.S. Pat. Nos. 3,705,805 and 3,707,375, the benzophenones disclosed in U.S. Pat. No. 3,215,530 and British Patent No. 1,321,355 and the polymeric compounds which have ultraviolet absorbing residue such as those disclosed in U.S. Pat. Nos. 3,761,272 and 4,431,726 can be used. The ultraviolet absorbing fluorescent whiteners disclosed in U.S. Pat. Nos. 3,499,762 and 3,700,455 can also be used. Typical examples of ultraviolet absorbers have been disclosed in RD 24239 (June 1984).

One or more types of surfactant may also be included for various purposes, as coating assistants, anti-static agents, agents for improving slip properties, emulsification and dispersion agents, and for the prevention of sticking and improvement of the photographic properties (for example the acceleration of development, raising of contrast and sensitization) etc.

Furthermore, water soluble dyes can be included in the hydrophilic colloid layers as filter dyes, or as anti-irradiation or anti-halation agents or for a variety of other purposes. The use of oxonol dyes, hemioxonal dyes, styryl dyes, merocyanine dyes, anthraquinone dyes and azo dyes is preferred for dyes of this type but cyanine dyes, azomethine dyes, triarylmethane dyes and phthalocyanine dyes are also useful. Oil soluble dyes can be emulsified with the oil in water dispersion method and added to a hydrophilic colloid layer.

The couplers used in the invention can be introduced into the photosensitive material using the various known dispersion methods.

Examples of the high boiling point organic solvents which can be used in the oil in water dispersion method have been disclosed in U.S. Pat. No. 2,322,027 etc.

Actual examples of the processes and effects and of the latexes used for impregnation purposes in the latex dispersion method have been disclosed in U.S. Pat. No. 4,199,363 and West German Patent Application (OLS) Nos. 2,541,274 and 2,541,230.

The invention is described by means of examples below but the invention is not limited by these examples.

EXAMPLE 1

Sample 101 consisting of a multi-layer color photosensitive material was prepared by coating in a laminar form on an undercoated cellulose triacetate film support the layers of which the compositions are indicated below.

Photosensitive Layer Compositions

The numbers corresponding to each component show the amount coated in units of grams per square meter, and in the case of silver halides the amount coated was calculated as silver. However, for the sensitizing dyes the amount coated is shown in units of mols per mol of silver halide in the same layer.

| Sample 101 | | |
|---|---|---|
| First Layer Anti-halation Layer | | |
| Black colloidal silver | (Silver) | 0.18 |
| Gelatin | | 0.40 |
| Second Layer Intermediate Layer | | |
| 2,5-di-tert-pentadecylhydroquinone | | 0.18 |
| EX-1 | | 0.07 |
| EX-3 | | 0.02 |
| EX-16 | | 0.004 |
| U-1 | | 0.08 |
| U-2 | | 0.08 |
| HBS-1 | | 0.10 |
| HBS-2 | | 0.02 |
| Gelatin | | 1.04 |
| Third Layer (First Red Sensitive Emulsion Layer) | | |
| Silver iodobromide emulsion (6 mol % silver iodide, average grain size 0.6μ) | (Silver) | 0.55 |
| Sensitizing dye I | | $6.9 \times 10^{-5}$ |
| Sensitizing dye II | | $1.8 \times 10^{-5}$ |
| Sensitizing dye III | | $3.1 \times 10^{-4}$ |
| Sensitizing dye IV | | $4.0 \times 10^{-5}$ |
| EX-2 | | 0.350 |
| HBS-1 | | 0.005 |
| EX-10 | | 0.020 |
| Gelatin | | 1.20 |
| Fourth Layer (Second Red Sensitive Emulsion Layer) | | |
| Silver iodobromide emulsion (8 mol % silver iodide, average grain size 0.8μ) | (Silver) | 1.0 |
| Sensitizing dye I | | $5.1 \times 10^{-5}$ |
| Sensitizing dye II | | $1.4 \times 10^{-5}$ |
| Sensitizing dye III | | $2.3 \times 10^{-4}$ |
| Sensitizing dye IV | | $3.0 \times 10^{-5}$ |
| EX-2 | | 0.300 |
| EX-3 | | 0.050 |
| EX-10 | | 0.015 |
| HBS-2 | | 0.050 |
| Gelatin | | 1.30 |
| Fifth Layer (Third Red Sensitive Emulsion Layer) | | |
| Silver iodobromide emulsion (16 mol % silver iodide, average grain size 1.1μ) | (Silver) | 1.6 |
| Sensitizing dye IX | | $5.4 \times 10^{-5}$ |
| Sensitizing dye II | | $1.4 \times 10^{-5}$ |
| Sensitizing dye III | | $2.4 \times 10^{-4}$ |
| Sensitizing dye IV | | $3.1 \times 10^{-5}$ |
| EX-5 | | 0.150 |
| EX-3 | | 0.055 |
| EX-4 | | 0.060 |
| HBS-1 | | 0.32 |
| Gelatin | | 1.63 |

-continued

| Sample 101 | | |
|---|---|---|
| Sixth Layer (Intermediate Layer) | | |
| Gelatin | | 1.06 |
| Seventh Layer (First Green Sensitive Emulsion Layer) | | |
| Silver iodobromide emulsion (6 mol % silver iodide, average grain size 0.6μ) | (Silver) | 0.40 |
| Sensitizing dye V | | $3.0 \times 10^{-5}$ |
| Sensitizing dye VI | | $1.0 \times 10^{-4}$ |
| Sensitizing dye VII | | $3.8 \times 10^{-4}$ |
| EX-6 | | 0.260 |
| EX-1 | | 0.021 |
| EX-7 | | 0.030 |
| EX-8 | | 0.025 |
| HBS-1 | | 0.100 |
| HBS-4 | | 0.010 |
| Gelatin | | 0.75 |
| Eighth Layer (Second Green Sensitive Emulsion Layer) | | |
| Silver iodobromide emulsion (9 mol % silver iodide, average grain size 0.7μ) | (Silver) | 0.80 |
| Sensitizing dye V | | $2.1 \times 10^{-5}$ |
| Sensitizing dye VI | | $7.0 \times 10^{-5}$ |
| Sensitizing dye VII | | $2.6 \times 10^{-4}$ |
| EX-13 | | 0.018 |
| EX-8 | | 0.010 |
| EX-1 | | 0.008 |
| EX-7 | | 0.012 |
| HBS-1 | | 0.60 |
| HBS-4 | | 0.06 |
| Gelatin | | 0.10 |
| Ninth Layer (Third Green Sensitive Emulsion Layer) | | |
| Silver iodobromide emulsion (12 mol % silver iodide, average grain size 1.0μ) | (Silver) | 1.2 |
| Sensitizing dye V | | $3.5 \times 10^{-5}$ |
| Sensitizing dye VI | | $8.0 \times 10^{-5}$ |
| Sensitizing dye VII | | $3.0 \times 10^{-4}$ |
| EX-6 | | 0.065 |
| EX-13 | | 0.030 |
| EX-1 | | 0.025 |
| HBS-2 | | 0.55 |
| HBS-4 | | 0.06 |
| Gelatin | | 1.74 |
| Tenth Layer (Yellow Filter Layer) | | |
| Yellow colloidal silver | (Silver) | 0.05 |
| A-1 | | 0.08 |
| HBS-1 | | 0.03 |
| Gelatin | | 0.95 |
| Eleventh Layer (First Blue Sensitive Emulsion Layer) | | |
| Silver iodobromide emulsion (6 mol % silver iodide, average grain size 0.6μ) | (Silver) | 0.24 |
| Sensitizing dye VIII | | $3.5 \times 10^{-4}$ |
| EX-9 | | 0.85 |
| EX-8 | | 0.12 |
| HBS-1 | | 0.28 |
| Gelatin | | 1.28 |
| Twelfth Layer (Second Blue Sensitive Emulsion Layer) | | |
| Silver iodobromide emulsion (10 mol % silver iodide, average grain size 0.8μ) | (Silver) | 0.45 |
| Sensitizing dye VIII | | $2.1 \times 10^{-4}$ |
| EX-11 | | 0.20 |
| EX-10 | | 0.015 |
| HBS-1 | | 0.03 |
| Gelatin | | 0.46 |
| Thirteenth Layer (Third Blue Sensitive Emulsion Layer) | | |
| Silver iodobromide emulsion (1 mol % silver iodide, average grain size 1.3μ) | (Silver) | 0.77 |
| Sensitizing dye VIII | | $2.2 \times 10^{-4}$ |
| EX-11 | | 0.20 |
| HBS-1 | | 0.07 |
| Gelatin | | 0.69 |
| Fourteenth Layer (First Protective Layer) | | |
| Silver iodobromide emulsion (1 mol % silver iodide, average grain size 0.07μ) | (Silver) | 0.5 |

-continued

| Sample 101 | |
|---|---|
| U-1 | 0.11 |
| U-2 | 0.17 |
| HBS-1 | 0.90 |
| Gelatin | 1.00 |
| Fifteenth Layer (Second Protective Layer) | |
| Poly(methyl methacrylate) grains (average grain size about 1.5 μm) | 0.54 |
| S-1 | 0.05 |
| S-2 | 0.20 |
| Gelatin | 0.72 |

Gelatin hardening agent H-1 and surfactant were added to each layer as well as the components indicated above.

Sample 102 and 103

Samples 102 and 103 were prepared by changing comparative compound A-1 in the tenth layer (yellow filter layer) of sample 101 to compounds (6) and (13) of this invention, these compounds being coated at the rate of 0.15 grams per square meter.

Samples 104, 105 and 106

Samples 104, 105 and 106 were prepared by adding comparative compound A-1 and compounds (6) and (13) of this invention at a coated rate of 0.15 grams per square meter to the sixth layer of samples 101, 102 and 103 respectively with the addition of 0.05 grams per square meter of HBS-1.

Samples 101–106 prepared were cut into strips 35 mm wide and then subjected to a 4,800° K., 20 CMS wedge exposure and processed in an automatic developing machine of which processes indicated in Table 1.

The processed samples so obtained were labelled $S_1$. Thus the $S_1$ samples were obtained when the processing baths were fresh.

Next photographs were taken on sample 101 and the material was processed with the processes indicated under Nos. 1–4 using the replenishment conditions shown in Table 2, 20 meters of material of width 35 mm being processed per day until the total amount of replenishment of the color development bath reached 20 liters.

TABLE 1

| Process | Processing Time | Processing Temp. | Replenishment Rate* | Tank Capacity (amount of liquid) |
|---|---|---|---|---|
| Color development | 3 min. 15 sec. | 37.8° C. | See Table 2 | 10 l |
| Bleaching | 6 min. 30 sec. | 37.8° C. | 3 ml | 20 l |
| Fixing | 3 min. 15 sec. | 37.8° C. | 8 ml | 10 l |
| Washing (1) | 1 min. 00 sec. | 35.0° C. | Counter-flow pipe system from (2) to (1) | 4 l |
| Washing (2) | 1 min. 40 sec. | 35.0° C. | 8 ml | 4 l |
| Stabilizing | 1 min. 20 sec. | 37.8° C. | 8 ml | 4 l |
| Drying | 1 min. 30 sec. | 52° C. | | |

*Replenishment rate per 100 $cm^2$ of sample

TABLE 2

(Processing Details)

| Process | Color Development Bath Replenishment Rate (per 100 $cm^2$ of photosensitive material) | Developer Replenishing Solution: Developing Agent | Developer Replenishing Solution: Potassium Bromide |
|---|---|---|---|
| 1 | 12 ml | 5.3 g/l | 0.7 g/l |
| 2 | 9 ml | 5.9 g/l | 0.5 g/l |
| 3 | 6 ml | 6.5 g/l | 0.2 g/l |
| 4 | 4 ml | 7.0 g/l | 0 g/l |

The composition of the processing baths were as follows:

| | Main Bath (grams) | Replenisher (grams) |
|---|---|---|
| Color Development Bath | | |
| Diethylenetriamine penta-acetic acid | 5.0 | 6.0 |
| Sodium sulfite | 4.0 | 4.4 |
| Potassium carbonate | 30.0 | 37.0 |
| Potassium bromide | 1.3 | As shown in Table 2 |
| Potassium iodide | 1.2 mg | — |
| Hydroxylamine sulfate | 2.0 | 2.8 |
| 4-(N-ethyl-N-β-hydroxyethyl-amino)-2-methylaniline sulfate | 4.7 | As shown in Table 2 |
| Water to make up to | 1.0 liter | 1.0 liter |
| pH | 10.00 | 10.05 |
| Bleach Bath | | |
| Ethylenediamine tetra-acetic acid iron(III) ammonium salt dihydrate | 100.0 | 120.0 |
| Ethylenediamine tetra-acetic acid di-sodium salt dihydrate | 10.0 | 12.0 |
| Ammonium bromide | 160.0 | 180.0 |
| Ammonium nitrate | 30.0 | 50.0 |
| Aqueous ammonium (27%) | 7.0 ml | 5.0 ml |
| Water to make up to | 1.0 liter | 1.0 liter |
| pH | 6.0 | 5.7 |
| Fixing Bath | | |
| Ethylenediamine tetra-acetic acid di-sodium salt | 0.5 | 0.7 |
| Sodium sulfite | 7.0 | 8.0 |
| Sodium bisulfite | 5.0 | 5.5 |
| Aqueous ammonium thio-sulfate solution (70%) | 170.0 ml | 200.0 ml |
| Water to make up to | 1.0 liter | 1.0 liter |
| pH | 6.7 | 6.6 |
| Water Washing Bath | | |
| The main bath and replenisher were the same. | | |
| 5-Chloro-2-methyl-4-isothiazolin-3-one | 6.0 mg | |
| 2-Methyl-4-isothiazolin-3-one | 3.0 mg | |
| Ethylene glycol | 1.5 | |
| Water to make up to | 1.0 liter | |
| pH | 5.0–7.0 | |
| Stabilizing Bath | | |
| The main bath and replenisher were the same. | | |
| Formalin (37%) | 3.0 ml | |
| Ethylene glycol | 2.0 grams | |
| Surfactant | 0.4 grams | |

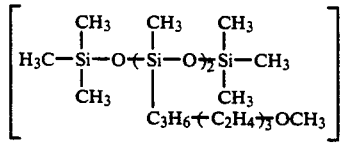

| | |
|---|---|
| Water to make up to | 1.0 liter |
| pH | 5.0–8.0 |

At the end of processing in accordance with the processes Nos. 1–4 indicated above, the same samples as samples 101–106 were subjected to wedge exposure and processed in the same manner as described above and samples thus obtained are referred to as the $S_2$ samples. Thus the $S_2$ samples were obtained using processing baths under constant running conditions.

The differences in gradation and the minimum densities between the $S_1$ and $S_2$ samples ($S_2$–$S_1$) were calculated and the results obtained are shown in Table 3 as values which indicate the change in performance between fresh baths and baths in the running condition.

Here gradation is the average gradation of minimum density within the range of ±0.2–1.5. The difference in the minimum densities indicates the variation of staining.

TABLE 3

| | Test No. | Process No. | Sample | Gradation Difference Y | Gradation Difference M | Gradation Difference C | Minimum Density Difference Y | Minimum Density Difference M | Minimum Density Difference C |
|---|---|---|---|---|---|---|---|---|---|
| Comparative Ex. | 1 | 1 | 101 | 0.02 | 0.01 | 0.01 | 0.01 | 0.00 | 0.00 |
| " | 2 | 2 | 101 | 0.04 | 0.03 | 0.04 | 0.05 | 0.04 | 0.03 |
| " | 3 | 3 | 101 | 0.07 | 0.08 | 0.09 | 0.06 | 0.06 | 0.05 |
| " | 4 | 4 | 101 | 0.11 | 0.13 | 0.14 | 0.11 | 0.09 | 0.07 |
| Comparative Ex. | 5 | 1 | 104 | 0.02 | 0.01 | 0.02 | 0.01 | 0.01 | 0.00 |
| " | 6 | 2 | 104 | 0.05 | 0.04 | 0.04 | 0.05 | 0.04 | 0.03 |
| " | 7 | 3 | 104 | 0.07 | 0.09 | 0.10 | 0.07 | 0.07 | 0.05 |
| " | 8 | 4 | 104 | 0.11 | 0.13 | 0.14 | 0.10 | 0.09 | 0.07 |
| Comparative Ex. | 9 | 1 | 102 | 0.02 | 0.01 | 0.02 | 0.01 | 0.00 | 0.00 |
| This Invention | 10 | 2 | 102 | 0.03 | 0.02 | 0.03 | 0.01 | 0.02 | 0.03 |
| " | 11 | 3 | 102 | 0.04 | 0.04 | 0.06 | 0.02 | 0.03 | 0.04 |
| " | 12 | 4 | 102 | 0.05 | 0.07 | 0.09 | 0.03 | 0.05 | 0.05 |
| Comparative Ex. | 13 | 1 | 105 | 0.02 | 0.01 | 0.02 | 0.01 | 0.00 | 0.00 |
| This Invention | 14 | 2 | 105 | 0.03 | 0.02 | 0.02 | 0.01 | 0.02 | 0.02 |
| " | 15 | 3 | 105 | 0.04 | 0.03 | 0.03 | 0.02 | 0.03 | 0.02 |
| " | 16 | 4 | 105 | 0.05 | 0.05 | 0.05 | 0.03 | 0.04 | 0.03 |
| Comparative Ex. | 17 | 1 | 103 | 0.02 | 0.01 | 0.02 | 0.01 | 0.00 | 0.00 |
| This Invention | 18 | 2 | 103 | 0.03 | 0.02 | 0.02 | 0.01 | 0.02 | 0.02 |
| " | 19 | 3 | 103 | 0.03 | 0.04 | 0.05 | 0.02 | 0.03 | 0.03 |
| " | 20 | 4 | 103 | 0.03 | 0.05 | 0.07 | 0.03 | 0.03 | 0.04 |
| Comparative Ex. | 21 | 1 | 106 | 0.02 | 0.01 | 0.02 | 0.01 | 0.00 | 0.00 |
| This Invention | 22 | 2 | 106 | 0.02 | 0.02 | 0.02 | 0.01 | 0.01 | 0.01 |
| " | 23 | 3 | 106 | 0.02 | 0.02 | 0.03 | 0.02 | 0.02 | 0.02 |
| " | 24 | 4 | 106 | 0.03 | 0.03 | 0.03 | 0.02 | 0.02 | 0.02 |

It is clear from the results shown in Table 3 that the difference in gradation and the difference in minimum density is very small even when the replenishment rate is reduced with this invention and stable processing can be achieved.

EXAMPLE 2

Experiments were carried out in the same way as in Example 1 except that the processing operation and the compositions of the processing baths were modified in the way indicated below.

As in the case of Example 1, the results showed that with this invention the gradation difference and the minimum density difference (staining difference) between the start and finish of the running test were very small when compared to those of the comparative examples and a stable performance was achieved.

TABLE 4

| Process | Processing Time | Processing Temp. | Replenishment Rate* | Tank Capacity (amount of liquid) |
|---|---|---|---|---|
| Color development | 3 min. 15 sec. | 38° C. | See Table 2 of Example 1 | 10 l |
| Bleaching | 1 min. 00 sec. | 38° C. | 5 ml | 4 l |
| Bleach-fixing | 3 min. 15 sec. | 38° C. | 8 ml | 8 l |
| Washing (1) | 40 sec. | 35° C. | Counter flow pipe system from (2) to (1) | 4 l |
| Washing (2) | 1 min. 00 sec. | 35° C. | 8 ml | 4 l |
| Stabilizing | 40 sec. | 38° C. | 5 ml | 4 l |
| Drying | 1 min. 15 sec. | 55° C. | | |

*Replenishment rate per 1 meter length × 35 mm wide

The compositions of the processing baths were as follows:

| | Main Bath (grams) | Replenisher (grams) |
|---|---|---|
| Color Development Bath | | |
| Diethylenetriamine pentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | As shown in Table 2 of Example 1 |
| Potassium iodide | 1.5 mg | |
| Hydroxylamine sulfate | 2.4 | 2.8 |
| 4-(N-ethyl-N-β-Hydroxyethylamino)-2-methylaniline sulfate | 4.5 | As shown in Table 2 of Example 1 |
| Water to make up to | 1.0 liter | 1.0 liter |
| pH | 10.05 | 10.10 |
| Bleach Bath | | |
| The main bath and replenisher were the same (units: grams). | | |
| Ethylenediamine tetra-acetic acid iron(III) ammonium salt dihydrade | 120.0 | |
| Ethylenediamine tetra-acetic acid di-sodium salt | 10.0 | |
| Ammonium bromide | 100.0 | |
| Ammonium nitrate | 10.0 | |
| Bleach Accelerating agent | 0.005 mol | |

-continued

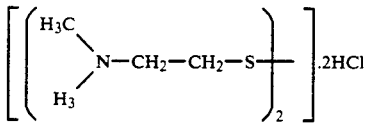

| | |
|---|---|
| Aqueous ammonium (27%) | 15.0 ml |
| Water to make up to | 10 liter |
| pH | 6.3 |
| Bleach-Fixing Bath | |
| The main bath and replenisher were the same (units: grams) | |
| Ethylenediamine tetra-acetic acid iron(III) ammonium salt dihydrate | 50.0 |
| Ethylenediamine tetra-acetic acid di-sodium salt | 5.0 |
| Sodium sulfite | 12.0 |
| Aqueous ammonium thiosulfate solution (70%) | 240.0 ml |
| Aqueous ammonia (27%) | 6.0 ml |
| Water to make up to | 1.0 liter |
| pH | 7.2 |

Water Washing Bath

The main bath and replenisher were the same.

Town water was passed through a mixed bed type column packed with an H-type strongly acidic cation exchange resin ("Amerlite IR-120B", made by the Rohm and Haas Co.) and an OH-type anion exchange resin ("Amberlite IR-400", made by the Rohm and Haas Co.) and treated so that the calcium and magnesium ion concentration was less than 3 mg/l and then 20 mg/l of sodium dichlorocyanurate and 1.5 g/l of sodium sulfate were added.

The pH of the resulting liquid was 6.5–7.5.

Stabilizing Bath

The main bath and replenisher were the same (units: grams).

| | |
|---|---|
| Formalin (37% aqueous solution) | 2.0 ml |
| Polyoxyethylene-p-monononylphenyl ether (average degree of polymerization 10) | 0.3 |
| Ethylenediamine tetra-acetic acid di-sodium salt | 0.05 |
| Water | to make up to 1.0 liter |
| pH | 5.0–8.0 |

EXAMPLE 3

Experiments were carried out in the same way as Example 1 except that the processing used in Example 1 was modified in the way indicated below and the amount of sample 101 processed was set at 10 meters of material of width 35 mm per day.

TABLE 5

| Process | Processing Time | Processing Temp. | Replenishment Rate* | Tank Capacity (amount of liquid) |
|---|---|---|---|---|
| Color development | 2 min. 15 sec. | 40° C. | See Table 6 | 8 l |
| Bleach-fixing | 3 min. 00 sec. | 40° C. | 20 ml | 8 l |
| Washing (1) | 20 sec. | 35° C. | Counter-flow pipe system | 2 l |

TABLE 5-continued

| Process | Processing Time | Processing Temp. | Replenishment Rate* | Tank Capacity (amount of liquid) |
|---|---|---|---|---|
| | | | from 2 to 1 | |
| Washing (2) | 20 sec. | 35° C. | 10 ml | 2 l |
| Stabilizing | 20 sec. | 35° C. | 10 ml | 2 l |
| Drying | 50 sec. | 65° C. | | |

*Replenishment rate per 1 meter length × 35 mm wide

Moreover, the circulation rate of the liquid in the color development tank during development was 5 liters per minute

TABLE 6

(Processing Details)

| Process | Color Development Bath Replenishment Rate (per 100 cm² of photosensitive material) | Concentration in Color Developer Replenisher: Developing Agent | Concentration in Color Developer Replenisher: Potassium Bromide | Color Development Bath |
|---|---|---|---|---|
| 1 | 12 ml | 5.5 g/l | 0.7 g/l | A* |
| 2 | 9 ml | 6.1 g/l | 0.5 g/l | A |
| 3 | 6 ml | 6.7 g/l | 0.2 g/l | A |
| 4 | 4 ml | 7.2 g/l | 0 g/l | A |
| 5 | 4 ml | 7.2 g/l | 0 g/l | B* |

*As in the processing bath compositions indicated below, the color development bath A contained diethylenetriamine penta-acetic acid and 1-hydroxyethylidene-1,1-diphosphonic acid, while color development bath B contained only diethylenetriamine penta-acetic acid.

| | Main Bath (grams) | Replenisher (grams) |
|---|---|---|
| Color Development Bath A | | |
| Diethylenetriamine penta-acetic acid | 2.0 | 2.2 |
| 1-Hydroxyethylidene-1,1-diphosphonic acid | 3.0 | 3.2 |
| Sodium sulfite | 4.0 | 5.5 |
| Potassium carbonate | 30.0 | 37.0 |
| Potassium bromide | 1.4 | As shown in Table 6 |
| Potassium iodide | 1.5 mg | — |
| Hydroxylamine sulfate | 2.4 | 3.0 |
| 4-(N-ethyl-N-β-hydroxyethyl-amino)-2-methylaniline sulfate | 5.0 | As shown in Table 6 |
| Water to make up to | 1.0 liter | 1.0 liter |
| pH | 10.10 | 10.20 |
| Color Development Bath B | | |
| Diethylenetriamine penta-acetic acid | 1.0 | 1.1 |
| Sodium sulfite | 4.0 | 5.5 |
| Potassium carbonate | 30.0 | 37.0 |
| Potassium bromide | 1.4 | As shown in Table 6 |
| Potassium iodide | 1.5 mg | — |
| Hydroxylamine sulfate | 2.4 | 3.0 |
| 4-(N-ethyl-N-β-hydroxyethyl-amino)-2-methylaniline sulfate | 5.0 | As shown in Table 6 |
| Water to make up to | 1.0 liter | 1.0 liter |
| pH | 10.10 | 10.20 |
| Bleach-Fixing Bath | | |
| The main bath and replenisher were the same (units: grams). | | |
| Ethylenediamine tetra-acetic acid iron(III) ammonium salt dihydrate | 50.0 | |
| Ethylenediamine tetra-acetic acid di-sodium salt | 5.0 | |
| Sodium sulfite | 12.0 | |
| Aqueous ammonium thiosulfate solution (70%) | 260.0 ml | |
| Acetic acid (98%) | 5.0 ml | |
| Bleach accelerator | 0.01 mol | |

TABLE 6-continued (Processing Details)

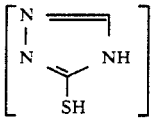

| | |
|---|---|
| Water to make up to | 1.0 liter |
| pH | 6.0 |

Stabilizing Bath
The main bath and replenisher were the same
(units: grams).

| | |
|---|---|
| Formalin (37%) | 2.0 ml |
| Polyoxyethylene-p-mononylphenyl ether (average degree of polymerization 10) | 0.3 |
| Ethylenediamine tetra-acetic acid di-sodium salt | 0.05 |
| Water | to make up to 1.0 liter |
| pH | 5.0–8.0 |

TABLE 7

| | Test No. | Process No. | Sample | Gradation Difference Y | M | C | Dependence on Agitation Y |
|---|---|---|---|---|---|---|---|
| Comparative Ex. | 1 | 1 | 101 | 0.02 | 0.02 | 0.02 | — |
| " | 2 | 2 | 101 | 0.06 | 0.05 | 0.06 | — |
| " | 3 | 3 | 101 | 0.12 | 0.10 | 0.12 | — |
| " | 4 | 4 | 101 | 0.15 | 0.13 | 0.16 | 0.07 |
| " | 5 | 5 | 101 | 0.15 | 0.13 | 0.16 | 0.07 |
| Comparative Ex. | 6 | 1 | 104 | 0.02 | 0.02 | 0.02 | — |
| " | 7 | 2 | 104 | 0.07 | 0.05 | 0.06 | — |
| " | 8 | 3 | 104 | 0.12 | 0.10 | 0.11 | — |
| " | 9 | 4 | 104 | 0.14 | 0.13 | 0.15 | 0.07 |
| " | 10 | 5 | 104 | 0.15 | 0.13 | 0.15 | 0.07 |
| Comparative Ex. | 11 | 1 | 102 | 0.02 | 0.02 | 0.02 | — |
| This Invention | 12 | 2 | 102 | 0.03 | 0.04 | 0.05 | — |
| " | 13 | 3 | 102 | 0.05 | 0.07 | 0.06 | — |
| " | 14 | 4 | 102 | 0.06 | 0.07 | 0.08 | 0.03 |
| " | 15 | 5 | 102 | 0.09 | 0.09 | 0.11 | 0.04 |
| Comparative Ex. | 16 | 1 | 105 | 0.02 | 0.02 | 0.02 | — |
| This Invention | 17 | 2 | 105 | 0.03 | 0.03 | 0.03 | — |
| " | 18 | 3 | 105 | 0.04 | 0.03 | 0.03 | — |
| " | 19 | 4 | 105 | 0.04 | 0.04 | 0.03 | 0.02 |
| " | 20 | 5 | 105 | 0.06 | 0.05 | 0.05 | 0.03 |
| Comparative Ex. | 21 | 1 | 103 | 0.01 | 0.01 | 0.02 | — |
| This Invention | 22 | 2 | 103 | 0.03 | 0.03 | 0.04 | — |
| " | 23 | 3 | 103 | 0.04 | 0.04 | 0.05 | — |
| " | 24 | 4 | 103 | 0.05 | 0.05 | 0.05 | 0.02 |
| " | 25 | 5 | 103 | 0.08 | 0.07 | 0.07 | 0.03 |
| Comparative Ex. | 26 | 1 | 106 | 0.01 | 0.01 | 0.01 | — |
| This Invention | 27 | 2 | 106 | 0.02 | 0.01 | 0.01 | — |
| " | 28 | 3 | 106 | 0.03 | 0.02 | 0.01 | — |
| " | 29 | 4 | 106 | 0.03 | 0.02 | 0.02 | 0.02 |
| " | 30 | 5 | 106 | 0.05 | 0.03 | 0.04 | 0.04 |

Water Washing Bath

Main bath and replenisher were the same.

Town water was passed through a mixed bed type column packed with an H-type strongly acidic cation exchange resin ("Amberlite IR-120B", made by the Rohm and Haas Co.) and an OH-type anion exchange resin ("Amberlite IR-400", made by the Rohm and Haas Co.) and treated so that the calcium and magnesium ion concentration was less than 3 mg/l and then 20 mg/l of sodium dichlorocyanurate and 130 mg/l of sodium sulfate were added.

The pH of the resulting liquid was within the range of 6.5–7.5.

The gradation difference and the dependence on agitation at the start (with a fresh bath) and on completion of the running test were investigated and the results obtained are shown in Table 7.

The dependence on agitation is shown by the variation in the yellow gradation of each sample when, on completion of the running test, the circulation rate of the developer in the tank was increased from 5 liters per minute to 8 liters per minute. As shown in Table 7, the gradation difference and the dependence on agitation were small when this invention was applied and it was clearly possible to achieve stable processing.

Furthermore, the color development bath A in which both diethylenetriamine penta-acetic acid and 1-hydroxyethylidene-1,1-diphosphonic acid were used clearly produced better results than the color development bath B which only contained the diethylenetriamine penta-acetic acid.

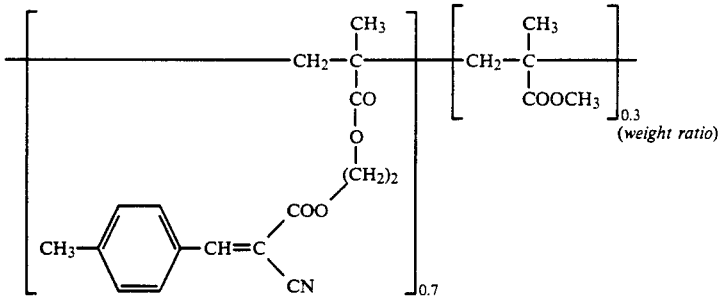
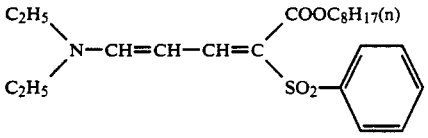
U-2
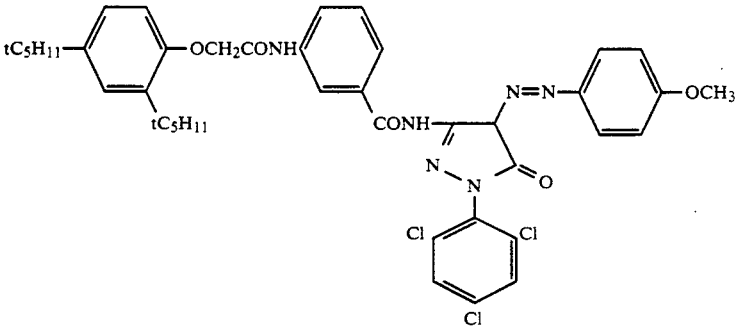
EX-1
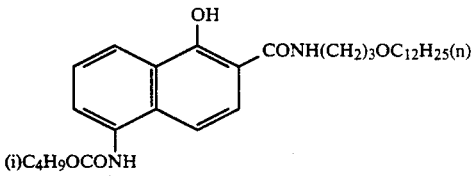
EX-2
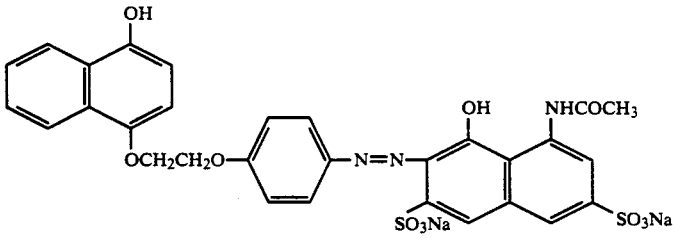
EX-3
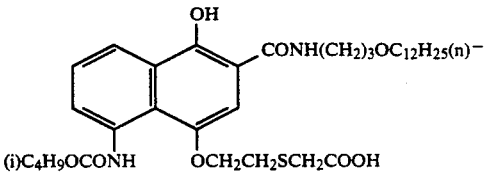
EX-4

-continued
EX-5
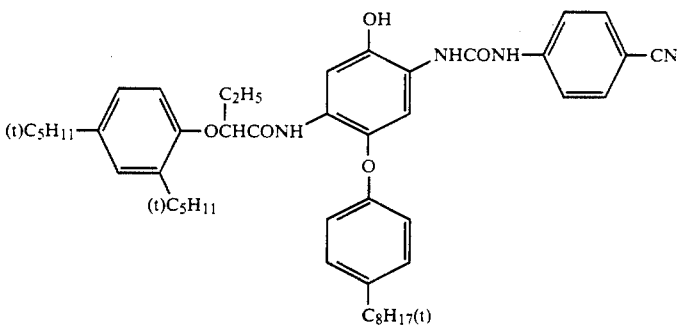
EX-6
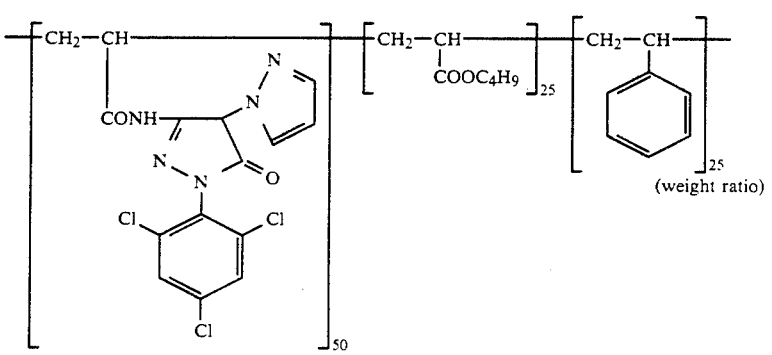
EX-7
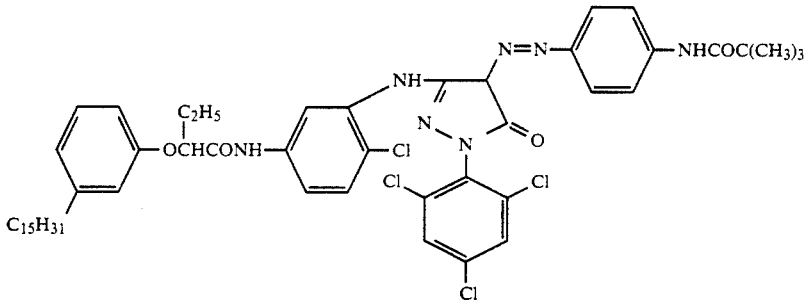
(Compound (49) in U.S. Pat. No. 4,477,563)
EX-8
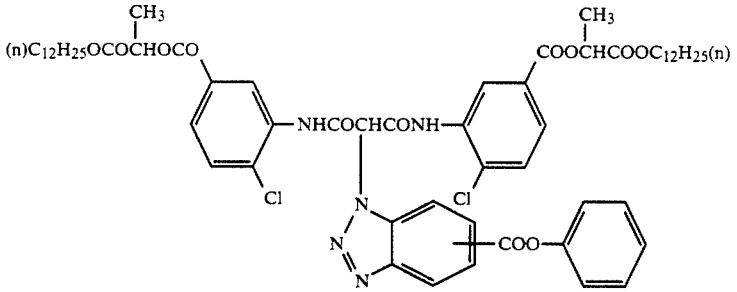
EX-9
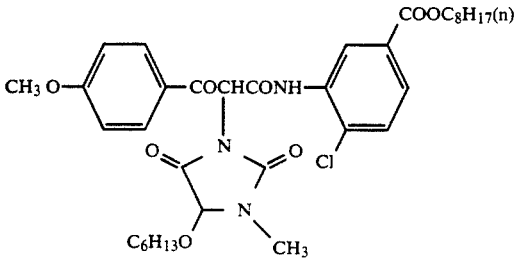
(Compound included in U.S. Pat. No. 4,477,563)

-continued
EX-10
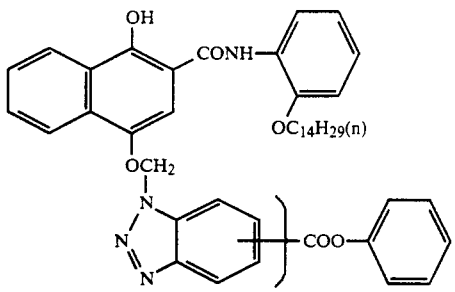
EX-11
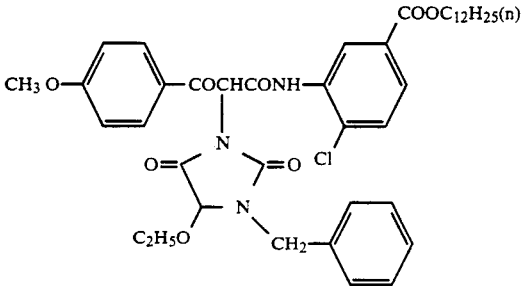
(Coupler disclosed in U.S. Pat. No. 3,227,554)
EX-12
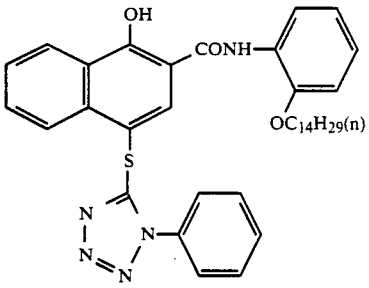
EX-13
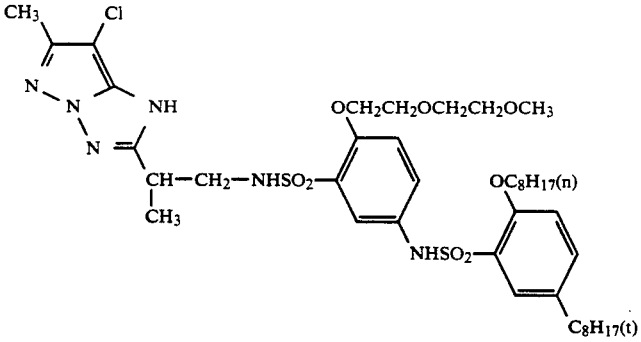
EX-14
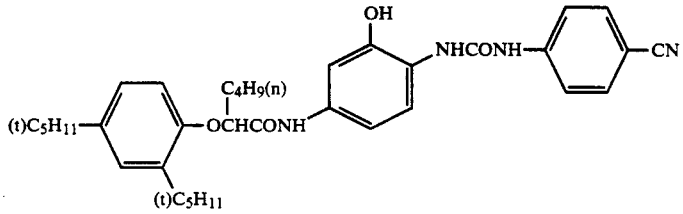

-continued
EX-15
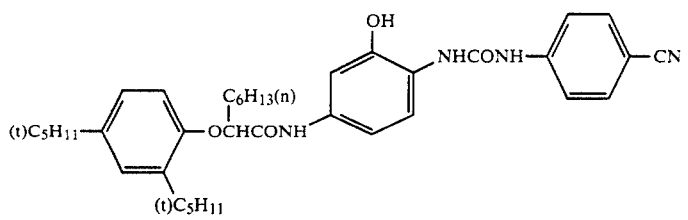
EX-16
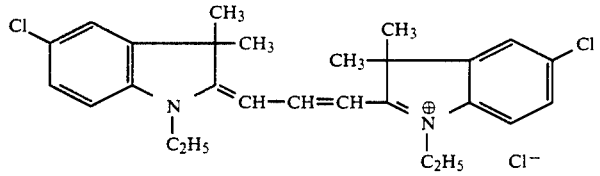
S-1
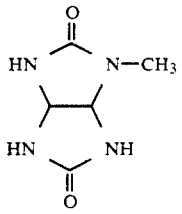
S-2
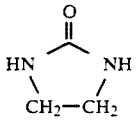
Tricresylphosphate HBS-1
Dibutylphthalate HBS-2
HBS-4
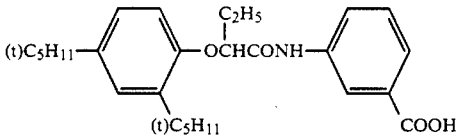
Bis(2-ethylhexyl)phthalate HBS-3
H-1
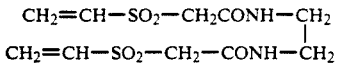
Sensitizing Dye
I
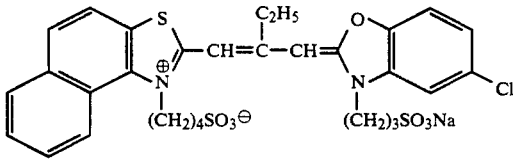
II
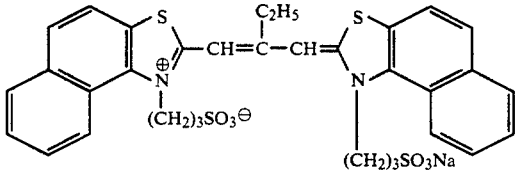

-continued

III

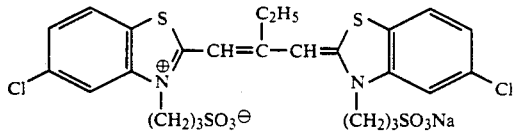

IV

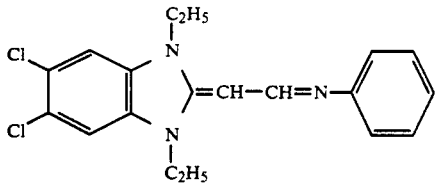

V

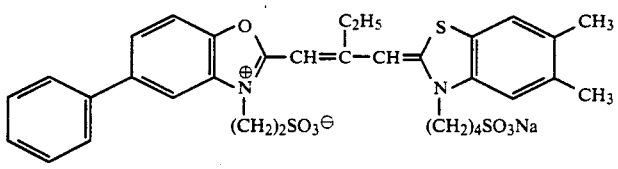

IX

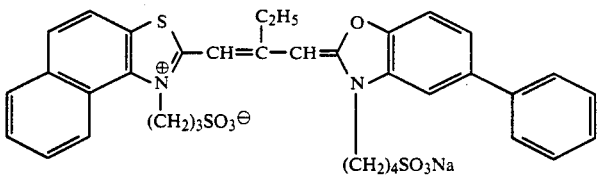

(Compound (6) in U.S. Pat. No. 2,336,327)

A-1

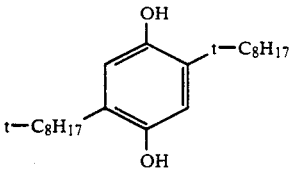

VI

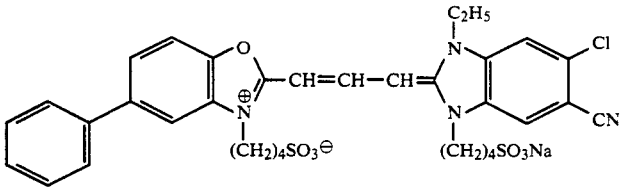

VII

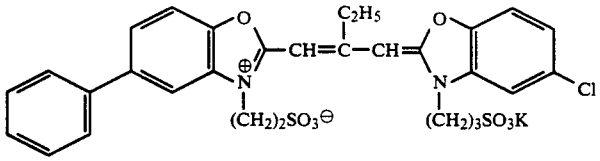

VIII

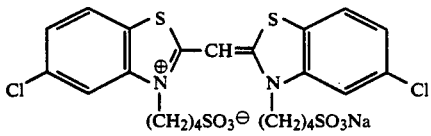

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photosensitive material, which comprises developing an image-wise light-exposed silver halide color photosensitive material containing at least one color coupler and at least one compound selected from the group consisting of compounds represented by formula (A), bis or tris compounds and polymers derived therefrom, and alkali unstable precursors thereof, in a color developer which is replenished at a rate of not more than 9 ml per 100 $cm^2$ of the silver halide color photosensitive material:

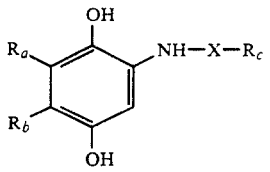

(A)

2. A method for processing a silver halide color photosensitive material as in claim 1, wherein the color developer is replenished at a rate of at least 1 ml per 100 $cm^2$ of the silver halide color photosensitive material.

3. A method for processing a silver halide color photosensitive material as in claim 1, wherein the compound is incorporated into the photosensitive material in an amount of from 0.003 to 2.0 $g/m^2$ of the photosensitive material.

4. A method for processing a silver halide color photosensitive material as in claim 1, wherein the compound is incorporated into a non-photosensitive layer.

5. A method for processing a silver halide color photosensitive material as in claim 1, wherein the color developer contains a bromide as an antifoggant in an amount of not more than $4\times10^{-3}$ mol per liter of the color developer.

6. A method for processing a silver halide color photosensitive material as in claim 1, wherein the color developer replenisher is substantially bromide free and replenished at a rate of not more than 5 ml.

7. A method for processing a silver halide color photosensitive material as in claim 1, wherein the color developer comprises a primary aromatic amine developing agent.

8. A method for processing a silver halide color photosensitive material as in claim 1, wherein the developing agent is incorporated in an amount of from 1 to 15 grams per liter of the color developer.

9. A method for processing a silver halide color photosensitive material as in claim 1, wherein the concentration of a developing agent in the solution used for replenishing is larger than that in the color developer.

10. A method for processing a silver halide color photosensitive material as in claim 1, wherein the color developer contains at least one compound selected from the group consisting of compounds represented by formula (B) and (C);

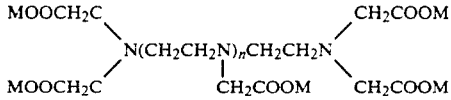

(B)

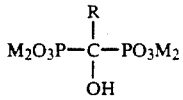

(C)

wherein n represents 1 or 2, R represents a lower alkyl group and M represents a hydrogen atom, an alkali metal atom or an ammonium group.

11. A method for processing a silver halide color photosensitive material as in claim 10, wherein the compound represented by formula (B) is incorporated in an amount of from $5\times10^{-4}$ to $5\times10^{-2}$ mol per liter of color developer.

12. A method for processing a silver halide color photosensitive material as in claim 10, wherein the compound represented by formula (C) is incorporated in an amount of from $1\times10^{-3}$ to $1\times10^{-1}$ mol per liter of color developer.

13. A method for processing a silver halide color photosensitive material as in claim 10, wherein the mol ratio of the amount of the compound represented by formula (C) to that of the compound represented by formula (B) is from 2 to 20.

14. A method for processing a silver halide color photosensitive material as in claim 10, wherein color developer contains a hydroxylamine compound as a preservation.

15. A method for processing a silver halide color photosensitive material as in claim 1, wherein following the development the photosensitive material is processed immediately in bleach-fixing bath without any intervening process.

16. A method for processing a silver halide color photo-sensitive material as in claim 1, wherein the total number of carbon atoms of $R_a$, $R_b$ and $R_c$ is from 15 to 64.

17. A method for processing a silver halide color photo-sensitive material as in claim 1, wherein $R_a$ and $R_b$ are hydrogen atoms.

* * * * *